US006754138B2

(12) United States Patent
Sakuyama

(10) Patent No.: US 6,754,138 B2
(45) Date of Patent: Jun. 22, 2004

(54) DATA TRANSMISSION/RECEPTION SYSTEM FOR ELECTRONIC TIMEPIECES

(75) Inventor: Masao Sakuyama, Tokorozawa (JP)

(73) Assignee: Citizen Watch Co., Ltd., Tokyo (JP)

( * ) Notice: Subject to any disclaimer, the term of this patent is extended or adjusted under 35 U.S.C. 154(b) by 20 days.

(21) Appl. No.: 10/156,559

(22) Filed: May 29, 2002

(65) Prior Publication Data

US 2002/0141290 A1 Oct. 3, 2002

Related U.S. Application Data

(62) Division of application No. 08/975,667, filed on Nov. 28, 1997, now Pat. No. 6,522,601, which is a continuation of application No. 08/295,668, filed as application No. PCT/JP93/01930 on Dec. 28, 1993, now abandoned.

(30) Foreign Application Priority Data

| | | |
|---|---|---|
| Jan. 8, 1993 | (JP) | 5-16783 |
| Feb. 16, 1993 | (JP) | 5-48783 |
| Apr. 2, 1993 | (JP) | 5-98388 |
| Nov. 30, 1993 | (JP) | 5-299485 |

(51) Int. Cl.[7] ..... G04C 11/00
(52) U.S. Cl. ..... 368/47; 368/1; 368/52
(58) Field of Search ..... 368/1–10, 47, 368/52, 200–203; 708/111; 128/904

(56) References Cited

U.S. PATENT DOCUMENTS

| | | | | |
|---|---|---|---|---|
| 4,051,663 A | | 10/1977 | Chihara et al. | 368/200 |
| 4,117,663 A | | 10/1978 | Mosimann et al. | 368/201 |
| 4,147,022 A | | 4/1979 | Ichikawa | 368/34 |
| 4,211,065 A | | 7/1980 | Schmitz et al. | 368/47 |
| 4,382,692 A | | 5/1983 | Wiget et al. | 368/157 |
| 4,407,019 A | | 9/1983 | Futami et al. | 368/200 |
| 4,763,309 A | | 8/1988 | Descombes | 368/201 |
| 4,853,682 A | | 8/1989 | Asano et al. | 368/1 |
| 4,879,669 A | | 11/1989 | Kirhara et al. | 364/550 |
| 5,570,297 A | * | 10/1996 | Brzenzinski et al. | 708/111 |
| 5,835,388 A | * | 11/1998 | Helm | 708/111 |
| 5,921,938 A | * | 7/1999 | Aoyama et al. | 129/904 |

FOREIGN PATENT DOCUMENTS

| | | |
|---|---|---|
| EP | 0 253 227 | 1/1988 |
| GB | 1 487 955 | 10/1977 |
| JP | 54-89672 | 7/1979 |
| JP | 54-36764 | 3/1980 |
| JP | 56-158980 | 12/1981 |
| JP | 57-201886 | 12/1982 |
| JP | 58-7190 | 2/1983 |
| JP | 58-7191 | 2/1983 |
| JP | 60-3579 | 1/1985 |
| JP | 62-147846 | 7/1987 |
| JP | 2-10189 | 1/1990 |
| JP | 3-218494 | 3/1991 |
| JP | 4-192746 | 7/1992 |

* cited by examiner

*Primary Examiner*—David Martin
*Assistant Examiner*—Jeanne-Marguerite Goodwin
(74) *Attorney, Agent, or Firm*—Finnegan, Henderson, Farabow, Garrett & Dunner, L.L.P.

(57) ABSTRACT

A data transmission/reception system for wrist-type electronic timepiece. The data transmission/reception system for electronic timepieces comprises a data transmission device for generating data signals, and an electronic timepiece that receives data signals from the data transmission device by utilizing a coil for driving the hands, wherein the electronic timepiece is provided with a timing signal-generating means which generates a timing signal, and the data transmission device is provided with a timing signal-receiving means which receives the timing signals output from said hand-driving coil and transmits data signals in synchronism with the timing signals that are received. The data are transmitted and received in an ordinary hand-moving state without halting the timepiece while the functions are being operated. Therefore, there is no need of adjusting the time after the operation of the functions.

21 Claims, 18 Drawing Sheets

DATA TRANSMISSION/RECEPTION SYSTEM FOR ELECTRONIC TIMEPIECES

This is a division of application Ser. No. 08/975,667 filed Nov. 28, 1997 now U.S. Pat. No. 6,522,601, which is a continuation of application Ser. No. 08/295,668, now abandoned, which is a 371 of PCT/JP93/01930, filed Dec. 28, 1993, which are incorporated herein by reference.

TECHNICAL FIELD

The present invention relates to a data transmission/reception system for electronic timepieces. More specifically, the invention relates to a data transmission/reception system that is capable of reliably executing mutual communication between an electronic timepiece and an external data transmission/reception device using upon timing signals generated by the electronic timepiece.

BACKGROUND ART

There have heretofore been placed on the market electronic digital timepieces, having a wrist-computer function, that perform communication with personal computers using electromagnetic induction. There have also been proposed wrist-type electronic analog timepieces that perform pace adjustment by receiving standard time signals from an external standard time signal-generating device by utilizing a coil of a converter that drives the hands (for example, see Japanese Patent Publications Nos. 7190/1983 and 7191/1983). In order for the timepiece to receive standard time signals of a period of one second from an external unit, the receiving condition is set by manipulating an external operating member such as the crown or the like and, at the same time, the frequency-dividing circuit is reset to wait for the input of a standard time signal. When a first standard time signal is input, the frequency-dividing circuit is liberated from the reset condition and a frequency deviation-measuring circuit starts counting. When a second standard time signal is input after one second has passed, a frequency deviation counted by the frequency deviation-measuring circuit is stored in a frequency deviation storage circuit to finish the automatic pace adjustment. The frequency-dividing circuit is reset again, automatically liberated from the reset condition after the passage of a predetermined period of time, and the ordinary operation is started. In the above-mentioned operation, a correct standard time signal of a period of one second fed from an external unit is counted by an internal counter and the timepiece operation is carried out by using this counted value as a subsequent period of one second. The standard time signal is received by utilizing a coil of a converter.

The above-mentioned system is very convenient permitting even a finished timepiece to accomplish the pace adjustment. The above constitution, however, is a one-way communication system in which a timepiece receives a correct standard time signal of a period of one second from the external unit, which does not require the synchronizing operation, discontinues the timepiece operation when an external operation member such as the crown is manipulated to receive standard time signals, and waits for the arrival of external signals (hereinafter referred to as an open system).

Therefore, the time must be adjusted again after the automatic pace adjustment has been effected.

In the process of producing electronic timepieces, furthermore, the module unit and the case are produced through separate steps and are finally combined together to finish the electronic timepiece which is the final product. In such electronic timepieces, the procedure for carrying out various adjustments such as pace adjustment, pace adjustment for temperature or the pressure, adjustment for other characteristic values and adjustment for changes in the pace and characteristics stemming from the mounting in the case, is executed in the stage of the module of before mounting in the case, and inspection is carried out again. When the pace and other characteristics deviate from the specified values, therefore, the case must be removed and adjustments must be carried out again, requiring cumbersome work.

In order to solve such problems, Japanese Unexamined Patent Publication (Kokai) No. 56-158980 discloses an idea for controlling the internal circuit from the outside of the electronic timepiece without removing the metallic case without, however, any concrete disclosure concerning the communication system or the control system but simply employing the aforementioned open system.

Japanese Unexamined Patent Publication (Kokai) No. 57-201886 discloses a method in which oscillation signals from a quartz oscillator in an electronic timepiece are received by a microphone, and are compared with reference signals to judge deviation in the pace of the electronic timepiece, and an adjustment signal is fed back to the electronic timepiece. However, even this method is based upon a prerequisite of using the open system in which the operation of the electronic timepiece must be halted.

Moreover, Japanese Unexamined Patent Publication (Kokai) No. 55-36764 discloses a technical idea related to an analog electronic timepiece in which a coil for driving a stepping motor receives other signals while a drive pulse is not being input to the coil. According to this technical idea, a capacitor is connected in parallel with the above coil in order to attenuate a generated counter electromotive force at an early time. This patent publication, however, does not at all disclose the mutual communication system which is the gist of the present invention and does not disclose, either, what signals are processed and by what methods.

DISCLOSURE OF THE INVENTION

In a conventional electronic timepiece constituted as described above and, particularly, in a multi-functional electronic timepiece having a variety of functions, it is necessary to suitably and frequently adjust the pace and a variety of functions. Since the open system has heretofore been employed as described above, however, the operation becomes so complex and cumbersome that a user finds it difficult to accomplish the adjustment. Or, if the adjustment operation is done, there arouses a problem in that the adjustment lacks precision. To carry out a variety of adjustment operations, furthermore, the electronic timepiece must in most cases be once stopped. After a predetermined adjustment operation is finished, an additional operation must be carried out to adjust for the time spent for executing the adjustment operation.

At present, therefore, the users are not enjoying the use of the electronic timepieces, inclusive of multi-functional electronic timepieces, to a sufficient degree in their perfectly adjusted state.

The object of the present invention is to provide an operation system for an electronic timepiece which is very simply constituted, can be simply operated, and can be manipulated by anybody at any time easily and correctly to adjust the pace of the electronic timepiece or to adjust various functions of the electronic timepiece by eliminating the aforementioned defects inherent in the prior art. In particular, the object of the present invention is to provide a data transmission/reception system which is capable of reliably executing the data transmission/reception operation between the electronic timepiece and the data transmission/reception device that supplies a predetermined adjustment signal to the electronic timepiece, i.e., which is capable of reliably executing the mutual communication between the electronic timepiece and the external data transmission/reception device maintaining synchronism based upon the timing signals generated from the electronic timepiece.

More concretely speaking, the object of the present invention is to provide a data transmission/reception system for wrist-type electronic timepieces that permits transmission to, and reception from, an external unit without the need of manipulating an external operation member such as the crown or the like but maintaining the hand-driving state, i.e., maintaining the operation of the timepiece at all times.

Another object of the present invention is to provide a data transmission/reception system in which a reception means in the electronic timepiece that receives a second data signal transmitted from the data transmission/reception device is so constituted that the reception possible period can be suitably changed, in order to prevent the infiltration of noise.

A further object of the present invention is to provide a data transmission/reception system for wrist-type electronic timepieces which permits transmission to, and reception from, an external unit without the need of manipulating an external operation member such as the crown or the like but maintaining the hand-driving state, i.e., maintaining the operation of the timepiece at all times, stores motor drive pulses that are generated while the data are being transmitted or received, and quickly feeds the hands to effect the correction relying upon the stored data after the transmission or reception has been finished.

In order to accomplish the above-mentioned object, the data transmission/reception system according to the present invention basically employs technical constitution that is described below. That is, in a data transmission/reception system for electronic timepieces comprising:

a data transmission/reception device which receives a first data signal from an external unit, generates a second data signal in response to said received data signal, and transmits said second data signal to the external unit; and an electronic timepiece equipped with a transmission/reception means which transmits the first data signal to said data transmission/reception device, and receives said second data signal from said data transmission/reception device;

the improvement wherein said electronic timepiece is provided with a timing signal-generating means, said data transmission/reception device is provided with a timing signal-receiving means that receives a timing signal output from the transmission/reception means of said electronic timepiece, and said data transmission/reception device transmits said second data signal to said electronic timepiece in synchronism with the timing signal that is received.

According to another aspect of the present invention, there is provided a data transmission/reception system for electronic timepieces comprising:

a data transmission/reception device which receives a first data signal from an external unit, generates a second data signal in response to said data signal that is received, and transmits said second data signal to the external unit;

an electronic timepiece equipped with a transmission/reception means which transmits the first data signal to said data transmission/reception device, and receives said second data signal from said data transmission/reception device; and a condition-varying means which changes in an external conditions and gives same to said electronic timepiece;

the improvement wherein said electronic timepiece is provided with a timing signal-generating means, said data transmission/reception device is provided with a timing signal-receiving means for receiving a timing signal output from the transmission/reception means of said electronic timepiece, and said data transmission/reception device transmits the data in synchronism with the timing signal that is received and controls the condition setting of said condition-varying means.

The words "first data signal" used in the present invention stand for a predetermined data signal including a timing signal transmitted from the electronic timepiece to the external data transmission/reception device, and the words "second data signal" stand for a data signal obtained through an operational processing by receiving the first data signal transmitted from the electronic timepiece by the data transmission/reception device, executing a predetermined operational processing based upon the first data signal, and transmitting the result thereof from the data transmission/reception device to the electronic timepiece according to a predetermined timing.

In the specification explaining the importance of the timing signal, furthermore, the first data signal may substantially stand for the timing signal.

BEST MODE FOR CARRYING OUT THE INVENTION

Embodiments of the data transmission/reception system using an electronic timepiece of the present invention will now be described in detail with reference to the drawings.

Figure 1:
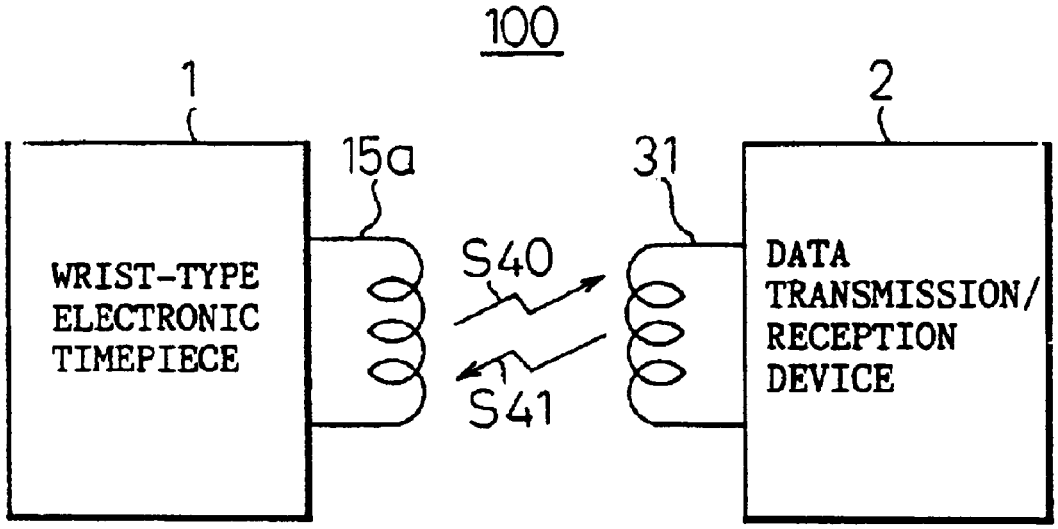
FIG. 1 is a block diagram of a data transmission/reception system comprising a wrist-type electronic timepiece equipped with a pace adjusting function and a data transmission/reception device according to a first embodiment of the present invention.
Figure 2:
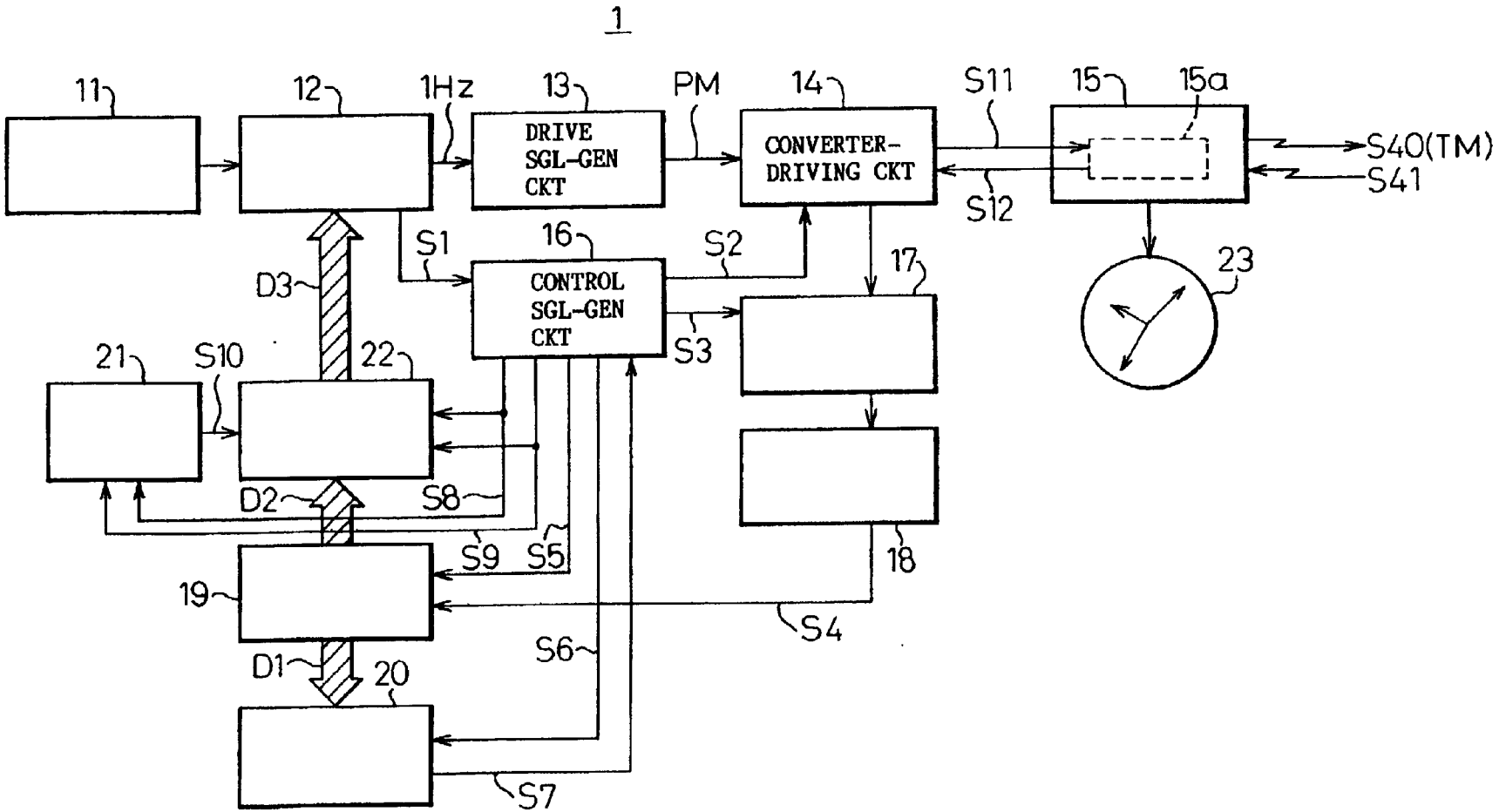
FIG. 2 is a block diagram illustrating major constituent portions in the wrist-type electronic timepiece of FIG. 1.
Figure 3:
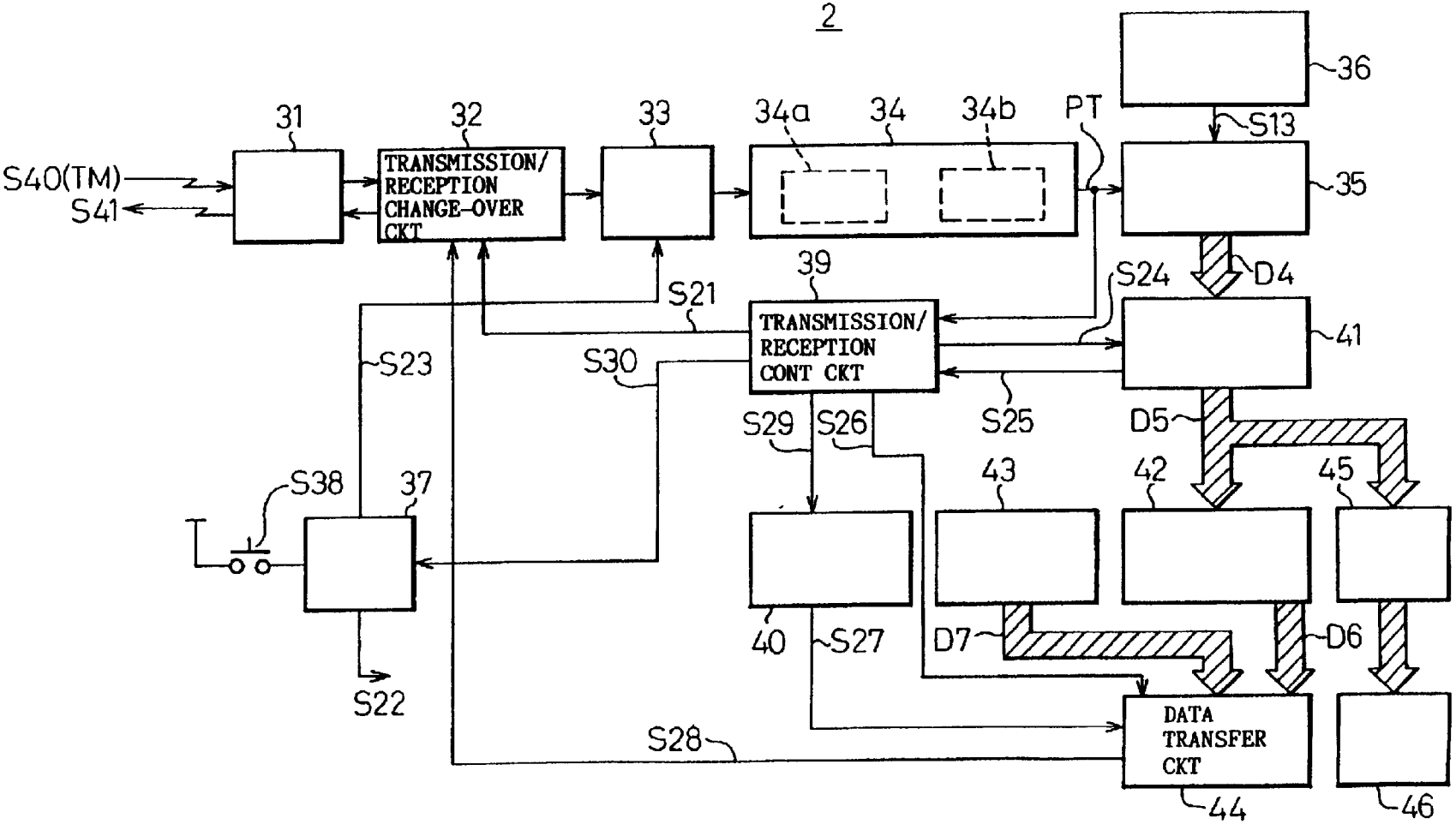
FIG. 3 is a block diagram illustrating major constituent portions in the data transmission/reception device of FIG. 1.

FIGS. 1 to 3 are block diagrams illustrating a basic constitution of the data transmission/reception system according to the present invention, i.e., illustrating a data transmission/reception system 100 for electronic timepieces comprising:

a data transmission/reception device 2 having a transmission/reception means 31 which receives a first data signal from an external unit, generates a second data signal in response to said data signal that is received, and transmits said second data signal to the external unit; and an electronic timepiece 1 equipped with a transmission/reception means 15*a* which transmits the first data signal to said data transmission/reception device 2, and receives said second data signal from said data transmission/reception device 2;

the improvement wherein said electronic timepiece 1 is provided with a timing signal-generating means 13, said data transmission/reception device 2 is provided with a transmission/reception means 31 means for receiving a timing signal TM output from the transmission/reception means 15*a* of said electronic timepiece 1, and said data transmission/reception device 2 transmits said second data signal to said electronic timepiece 1 in synchronism with the timing signal TM that is received.

Embodiment 1

The constitution of the data transmission/reception system 100 will now be described in further detail as embodiment 1. FIG. 1 is a block diagram of a data reception system in a wrist-type electronic timepiece equipped with a pace adjustment function according to a first embodiment of the present invention, and wherein reference numeral 1 denotes a wrist-type electronic timepiece equipped with a converter coil 15*a* for driving the hands, and 2 denotes a data transmission/reception device equipped with a transmission/reception coil 31. The transmission/reception coil 31 transmits and receives data to, and from, the coil 15*a* for the converter, i.e., to and from, the coil 15*a* for driving the hands. The data transmission/reception device 2 receives, through the transmission/reception coil 31 a timing signal generated from the converter coil 15*a* of the wrist-type electronic timepiece 1, and transmits to the converter coil 15*a* transmission data in synchronism with a timing signal that is received.

FIG. 2 is a block diagram of the circuit of the wrist-type electronic timepiece 1 according to the present invention, wherein reference numeral 11 denotes an oscillation circuit which employs a quartz oscillator to generate reference signals, 12 denotes a frequency-dividing circuit which outputs a 1-Hz signal and a frequency-divided signal S1 upon inputting an oscillation signal from the oscillation circuit 11, and reference numeral 13 denotes a drive-signal-generating circuit which accepts the 1-Hz signal from the frequency-dividing circuit 12 and outputs to a converter-driving circuit, i.e., to a hand-driving circuit 14, a motor drive pulse PM as a timing signal for driving the hands.

Reference numeral 15*a* denotes a converter for driving a hand 23, i.e., denotes a hand-driving coil provided for a hand-driving device 15, the hand-driving coil 15 working as a transmission/reception coil for transmitting and receiving the data to, and from, said data transmission/reception device 2.

In this embodiment, a hand drive signal S11 which is a hand-moving pulse fed to the hand-driving coil 15*a* turns into a timing signal TM contained in a first data signal S40 that is transmitted to the data transmission/reception device 2 and, hence, the drive signal-generating circuit 13 also works as a timing signal-generating circuit.

Reference numeral 16 denotes a control signal-generating circuit which accepts the frequency-divided signal S1, and outputs many control signals, such as reception possible signal S2 and like, to place the hand-driving circuit 14 in the receiving state. Reference numeral 17 denotes a gate circuit which inhibits or permits the passage of a reception signal S12 received from the converter coil 15*a* depending upon a detect permit signal S3 output from the control signal-generating circuit 16, and reference numeral 18 denotes a pace adjust signal-detecting circuit which converts the reception signal that has passed through the gate circuit 17 into a pace adjust signal S4.

Reference numeral 19 denotes a shift register which stores the pace adjust signal S4 from the pace adjust signal-detecting circuit 18 in response to a data shift signal S5 output from the control signal-generating circuit 16, and outputs a data signal D1 and a data signal D2.

Reference numeral 20 denotes a rewrite judging circuit which judges whether the output signal D1 for outputting the data signal stored in the shift register 19 is effective or not relying upon a data judge signal S6 output from the control signal-generating circuit 16, and outputs a data rewrite permit signal S7 to the control signal-generating circuit 16 when the output signal D1 is proper. Reference numeral 21 denotes a booster circuit which works to boost the voltage in response to an erase signal S8 and a rewrite signal S9 output from the control signal-generating circuit 16, and outputs a boosted signal S10 for only a predetermined period of time. Reference numeral 22 denotes a pace adjusting amount storage circuit constituted by a nonvolatile memory or the like, and inputs the data signal D2 from the shift register 19 and the boosted signal S10 from the booster circuit 21, and erases or writes the data relying upon the erase signal S8 or the write signal S9 output from the control signal-generating circuit 16. Thus, a pace data D3 is fed from the pace adjusting amount storage circuit 22 to the frequency-dividing circuit 12.

FIG. 3 is a block diagram of the circuit of the data transmission/reception device 2 according to the present invention. The data transmission/reception device 2 according to this embodiment is a pace adjusting device which receives the hand-moving pulse from the wrist-type electronic timepiece 1 as a pace detect signal, measures the pace based thereupon, and transmits a pace adjust data which is based thereupon.

Reference numeral 31 denotes the coil for transmission and reception, 32 denotes a transmission/reception change-over circuit which controls the change-over operation to receive a first data signal S40 including a timing signal TM from the hand-driving coil 15*a* and to transmit the data to the hand-driving coil 15*a* depending upon a change-over signal S21 from a transmission/reception control circuit 39 that will be described later, 33 denotes a gate circuit which inhibits or permits the passage of the first data signal S40 that includes the timing signal TM, 34 denotes a pace signal-detecting circuit which is constituted by a filter circuit 34*a* and an amplifier circuit 34*b*, inputs the timing signal from the gate circuit 33 and detects it as a pace detect pulse PT, and reference numeral 35 denotes a period-measuring circuit which inputs the pace detect pulse PT, measures an interval among a plurality of pace detect pulses PT using a reference signal S13 from a reference signal-generating circuit 36, and outputs a measured data D4.

Here, it need not be pointed out that the first data signal S40 and a second data signal S41, that will be mentioned later and are used in the present invention, assume the form of electromagnetic signals when they are practically exchanged between the electronic timepiece and the data transmission/reception device.

Reference numeral 37 denotes a start-of-measurement storage circuit which, upon the manipulation of a switch 38, outputs a system clear signal S22 for initializing the data transmission/reception device 2 and, at the same time, outputs a reception permit signal S23, so that the gate circuit 33 permits the passage of the first data signal S40 from the hand-driving coil 15*a*, reference numeral 39 denotes a transmission/reception control circuit which inputs the pace detect pulse PT and outputs many control signals such as a change-over signal S21 and like signals to place the transmission/reception change-over circuit 32 in the transmitting state, and reference numeral 41 denotes a pace adjusting amount operation circuit which inputs the measured data D4 and starts operating the amount of pace adjustment in response to an operation instruction signal S24 output from the transmission/reception control circuit 39. After the operation is finished, the pace adjusting amount operation circuit 41 outputs an adjustment amount data D5 and outputs an operation end signal S25 to the transmission/reception control circuit 39. Reference numeral 42 denotes a transmission data preparation circuit which inputs the adjustment amount data D5 from the pace adjusting amount operation circuit 41 and converts it into a data signal D6 in the form of a binary code, 43 denotes a rewrite command-forming circuit which forms a data signal D7 having such a meaning that the data signal D6 will now be transmitted to the wrist-type electronic timepiece 1, reference numeral 45 denotes a display circuit constituted by a converter circuit which inputs the adjustment amount data D5 from the pace adjusting amount operation circuit 41 and converts it into ppm or a daily variation from a reference value and a drive circuit for driving a display unit 46 equipped with LCD and the like.

Reference numeral 44 denotes a data transfer circuit which accepts the data signal D6 and the data signal D7, and is latched by a latch signal S26 which is output from the transmission/reception control circuit 39, and outputs a transmission signal S28 in which the data signal D7 and the data signal D6 are transformed into serial data in response to clock signals S27 from a clock-generating circuit 40 that will be described below. The transmission signal S28 is transmitted as a second data signal S41 from the coil 31 to the side of the electronic timepiece 1.

Reference numeral 40 denotes a clock generating circuit which outputs the clock signal S27 for driving the data transfer circuit 44 in response to a start signal S29 output from the transmission/reception control circuit 39. Further, a transmission end signal S30 output from the transmission/reception control circuit 39 resets the start-of-measurement storage circuit 37 to initialize the data transmission/reception device 2 and, at the same time, the gate circuit 33 inhibits the passage of a timing signal from the hand-driving coil 15*a*.

Next, the operation of the data reception system of the wrist-type electronic timepiece 1 equipped with the pace adjustment function constituted as described above, will now be explained with reference to a time chart shown in FIG. 4. In an ordinary operation of the wrist-type electronic timepiece 1, the drive signal-generating circuit 13 receives a 1-Hz signal from the frequency-dividing circuit 12 and outputs a motor drive pulse PM which is a timing signal. The hand-driving circuit 14 receives the motor drive pulse PM and feeds the hand drive-driving signal S11 to the hand-driving coil 15*a* which then drives the hand-driving device 23 to display the time while effecting the one-second hand movement. After the one-second hand movement is finished, the control signal-generating circuit 16 receives the frequency-divided signal S1 from the frequency-dividing circuit 12 and outputs a reception possible signal S2 to change the hand-driving circuit 14 over to the receiving state, such that a transmission signal S28 from the data transmission/reception device 2 is received by the hand-driving coil 15*a*. At the same time, the control signal-generating circuit 16 outputs a detection permit signal S3 so that the gate circuit 17 permits the passage of the received signal S12. Thus, the wrist-type electronic timepiece 1 finishes its hand-moving operation and is held in a reception possible state for the period of the reception possible signal S2 until the next hand-moving operation.

In order to receive the timing signal TM from the wrist-type electronic timepiece 1, on the other hand, the data transmission/reception device 2 is, first, initialized by manipulating the switch 38. Upon manipulating the switch 38, the start-of-measurement storage circuit 37 outputs a system clear signal S22 and a reception permit signal S23. In response to a change-over signal S21 output from the transmission/reception control circuit 39 or the system clear signal S22, the transmission/reception change-over circuit 32 is changed over to the reception mode so as to receive the timing signal TM from the wrist-type electronic timepiece 1. At the same time, in response, for example, to the system clear signal S22, the rewrite command-forming circuit 43 forms and outputs the data signal D7. The reception permit signal S23 from the start-of-measurement storage circuit 37 controls the gate circuit 33 to permit the passage of the timing signal TM from the transmission/reception coil 31. Tho timing signal TM of the wrist-type electronic timepiece 1 that is received during this state passes through the gate circuit 33 and is input to the pace signal-detecting circuit 34 which then detects a pace detect pulse PT which is a first timing signal TM (timing t1 in a time chart of FIG. 4). A period-measuring circuit 35 starts counting the reference signals S13 produced by the reference signal-generating circuit 36 from the moment t1 when the first pace detect pulse PT1 was input.

Then, the wrist-type electronic timepiece 1 outputs a next timing signal TM, which is then received by the transmission/reception coil 31, whereby the pace signal-detecting circuit 34 outputs a second pace detect pulse PT2 (timing t2 in the time chart of FIG. 2). The period-measuring circuit 35 then stops counting the reference signals S13 and outputs measurement data D4. At the same time, upon receiving the second pace detect pulse PT2, the transmission/reception control circuit 39 which is the reception timing signal-generating means sends an operation instruction signal S24 to the pace adjusting amount operation circuit 41 which then starts operating the pace adjusting amount and outputs an adjusting amount data D5 after the operation is finished and further outputs an operation end signal S25 to the transmission/reception control circuit 39. The adjusting amount data D5 output from the pace adjusting amount operation circuit 41 is converted into a data signal D6 in the form of a binary code through the transmission data-forming circuit 42. The adjusting amount data D5 is converted into a daily variation through the display circuit 45 and is displayed on the display unit 46.

Figure 4:
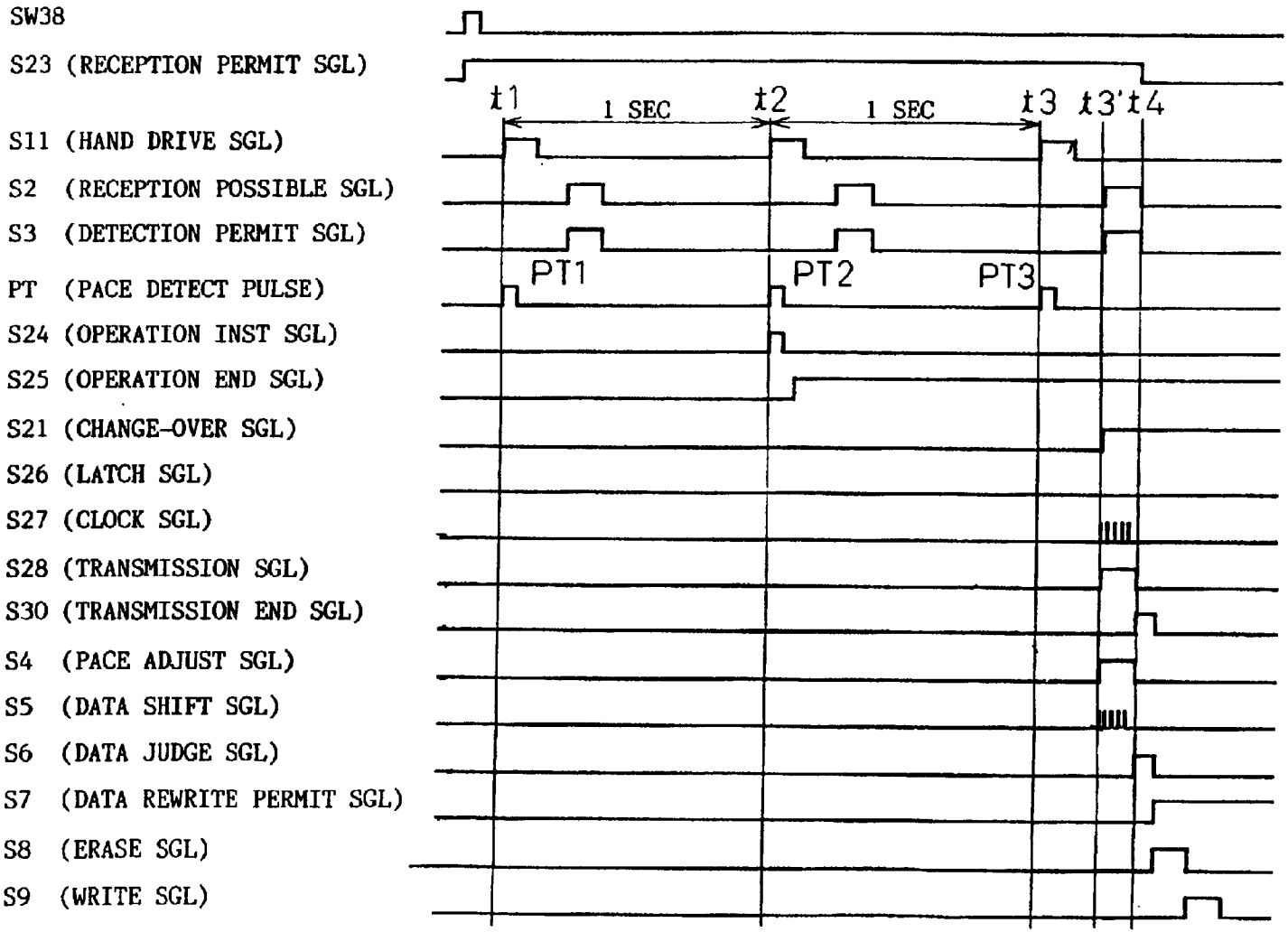
FIG. 4 is a time chart for explaining the operation of the first embodiment of the present invention.

The wrist-type electronic timepiece 1 outputs a further timing signal TM which is then received by the transmission/reception coil 31, whereby the pace signal-detecting circuit 34 outputs a third pace detect pulse PT3 (timing t3' in the time chart of FIG. 4). Then, the transmission/reception control circuit 39 that is receiving the pace detect pulse PT3 outputs a latch signal S26, so that the data signal D7 and the data signal D6 are stored in the data transfer circuit 44.

The transmission/reception control circuit 39 further outputs a change-over signal S21 (t3' in the time chart of FIG. 4) in synchronism with the pace detect pulse PT3 to place the transmission/reception change-over circuit 32 in the transmitting state. In response to a clock signal S27 from the clock-generating circuit 40 operated by a start signal S29 that is produced next from the transmission/reception control circuit 39, the data signal D7 and the data signal D6 stored in the data transfer circuit 44 are successively output as transmission signals S28.

The transmission signals S28 are transmitted to the wrist-type electronic timepiece 1 via the transmission/reception change-over circuit 32 and the transmission/reception coil 31. After the transmission signals S28 are transmitted, the transmission/reception control circuit 39 outputs a transmission end signal S30. The timings for transmitting the above series of transmission signals S28 are in agreement with the state where the control signal-generating circuit 16 in the wrist-type electronic timepiece 1 is outputting the reception possible signals S2, i.e., in agreement with the receiving state of the wrist-type electronic timepiece 1 as represented by the change-over signal S21 and the reception possible signals S2 of the wrist-type electronic timepiece 1 in the time chart of FIG. 4.

The transmission end signal S30 from the transmission/reception control circuit 39 is input to the start-of-measurement storage circuit 37; i.e., the start-of-measurement storage circuit 37 is reset, the reception permit signal S23 is no longer output, and the gate circuit 33 is closed. Thus, one pace adjusting operation is finished. The pace adjusting operation can be carried out again, as desired, by depressing the switch 38.

The transmission signal S28 transmitted from the data transmission/reception device 2, on the other hand, will be received by the hand-driving coil 15*a* of the wrist-type electronic timepiece 1. The operation will be described hereinbelow. In the wrist-type electronic timepiece 1, the reception possible signal S2 output from the control signal-generating circuit 16 changes the hand-driving circuit 14 over to the receiving state, whereby the transmission signal S28 constituted by a data signal D7 and a data signal D6 transmitted from the data transmission/reception device 2 is received by the hand-driving coil 15*a* as a reception signal S12.

The reception signal S12 that is received passes through the gate circuit 17, is detected by a pace adjust signal-detecting circuit 18, and is output as a pace adjust signal S4. The pace adjust signals S4 that are detected are successively stored in the shift register 19 in response to data shift signals S5 output from the control signal-generating circuit 16. When the pace adjust signals S4 are stored, the data signal D7 is output as a data signal D1 to the rewrite judging circuit 20, and the data signal D6 is output as a data signal D2 to the pace adjusting amount storage circuit 22.

After having output the data shift signal S5, the control signal-generating circuit 16 outputs a data judge signal S6 to the rewrite judging circuit 20. The rewrite judging circuit 20 judges whether the data signal D1 is proper or not, and outputs a data rewrite permit signal S7 when the data signal D1 is properly received. When the rewrite judging circuit 20 so judges that the data signal D1 is not proper, no data rewrite permit signal S7 is output, and the pace is not adjusted.

Upon receipt of the data rewrite permit signal S7, the control signal-generating circuit 16 outputs an erase signal S8 to set the pace adjusting amount storage circuit 22 to the erase mode and, at the same time, energizes the booster circuit S21, so that the data in the pace adjusting amount storage circuit 22 is erased by a boosted signal S10. Then, the control signal generating circuit 16 outputs a write signal S9 to set the pace adjusting amount storage circuit 22 to the write mode and, at the same time, energizes the booster circuit 21 so that the data signal D2 which is the adjusting amount data is written into the pace adjusting amount storage circuit 22 in response to the boosted signal S10. Adjustment of pace is thus finished.

According to the timepiece of the above-mentioned embodiment which produces the hand-moving pulse every second, there is no need to provide any special clock pulse circuit since the hand-moving pulse having a period of one second itself can be used as a timing signal.

As will be obvious from the above-mentioned embodiment, the data transmission/reception system using an electronic timepiece of the present invention has a technical feature in that a casting vote for manipulating the data transmission and reception is provided on the side of the electronic timepiece making it possible to adjust the pace without halting the operation of the electronic timepiece, as well as to adjust characteristics related to various functions and to effect compensation operations arbitrarily and at any time.

That is, when the first data signal or the second data signal is exchanged between the electronic timepiece 1 and the data transmission/reception device 2 like in a customary manner, the data transmission/reception device 2 may output all of its control instructions to transmit and receive the data signals. On the side of the electronic timepiece, however, it is quite uncertain when the pulse signals for the above operations will be received. In order to execute the adjusting operations, therefore, the operation must be halted on the side of the electronic timepiece, resulting in the occurrence of the problems mentioned above.

In order not to halt the operation of the electronic timepiece, furthermore, the circuit for executing the arithmetic operation must inevitably be fabricated to include a storage circuit; i.e., the circuit becomes bulky affecting the size and cost of the electronic timepiece.

According to the present invention, therefore, the electronic timepiece does not contain a large operation circuit and is hence driven with a power source which is as small as possible. In transmitting or receiving the data, an initiative for transmitting or receiving the data is given to the side of the electronic timepiece which has many limitations, so that a variety of adjustment operations can be executed without halting the operation of the electronic timepiece, and the electronic timepiece is permitted to carry out important processing while transmitting and receiving the data.

Concretely speaking, the electronic timepiece 1 is provided with timing signal-generating means, and a predetermined timing signal is transmitted from the electronic timepiece 1 to the data transmission/reception device 2 while a drive signal for driving the hands of the electronic timepiece is not being input, and a data related to the result of a particular processing is received from the data transmission/reception device 2 while the drive signal for driving the hands is not being input.

That is, in the present invention, when the data signals are to be transmitted and received, the timings for executing predetermined operations are all determined by the electronic timepiece. Therefore, the constitution is simplified, energy is consumed in reduced amounts, and the cost is decreased.

That is, the above-mentioned first embodiment of the present invention is concerned with a data transmission system 100 for electronic timepieces comprising a data transmission/reception device 2 which generates a data signal, and an electronic timepiece 1 which receives the data signal from said data transmission/reception device 2 by utilizing a coil 15*a* for driving the hands, wherein said electronic timepiece 1 is provided with a timing signal-generating means 13 which generates a timing signal TM, said data transmission/reception device 2 is provided with a transmission/reception means 31 for receiving the timing signal TM which is a first data signal output from said coil 15*a* for driving the hands, and said data transmission/reception device 2 transmits a second data signal obtained through a particular operational processing in synchronism with the timing signal TM that is received.

In the above-mentioned embodiment, furthermore, the timing signal-generating means 13 also works as a drive signal-generating circuit, and the timing signal TM becomes a hand drive-driving signal S11.

Moreover, the data transmission/reception device 2 has a transmission/reception control circuit that operates in synchronism with the timing signals TM to transmit the data signals among the consecutive timing signals.

That is, in the data transmission/reception system using the electronic timepiece according to the present invention, it is important that the electronic timepiece 1 is so constituted as to rewrite the data in the electronic timepiece 1 in response to the second data signal transmitted from the data transmission/reception device 2.

The electronic timepiece according to the present invention further has a data signal detection permitting means 17 which, after having generated the timing signal TM, receives the second data signal transmitted from the data transmission/reception device 2 for only a predetermined reception possible time.

The electronic timepiece 1 has means 15 for driving the hands such as conversion means having a function for converting a voltage into a rotational driving force like a pulse motor or the like, and wherein the coil 15*a* for driving the hands also works as the transmission/reception means, to which only, however, the invention is in no way limited, and a transmission/reception coil may be separately provided.

In the present invention, the data signal detection permitting means 17 is so constituted as to be operated by the detection permit signal S3 that sets a reception possible period in the hand non-driving period between the converted drive signals S11.

In the present invention, furthermore, the data transmission/reception device 2 generates a second data signal S41 obtained through a predetermined operational processing in synchronism with the timing signal TM contained in the first data signal transmitted from the electronic timepiece 1.

Embodiment 2

Next, a second embodiment related to the data transmission/reception system using the electronic timepiece according to the present invention will be described with reference to FIG. 5.

Figure 5:
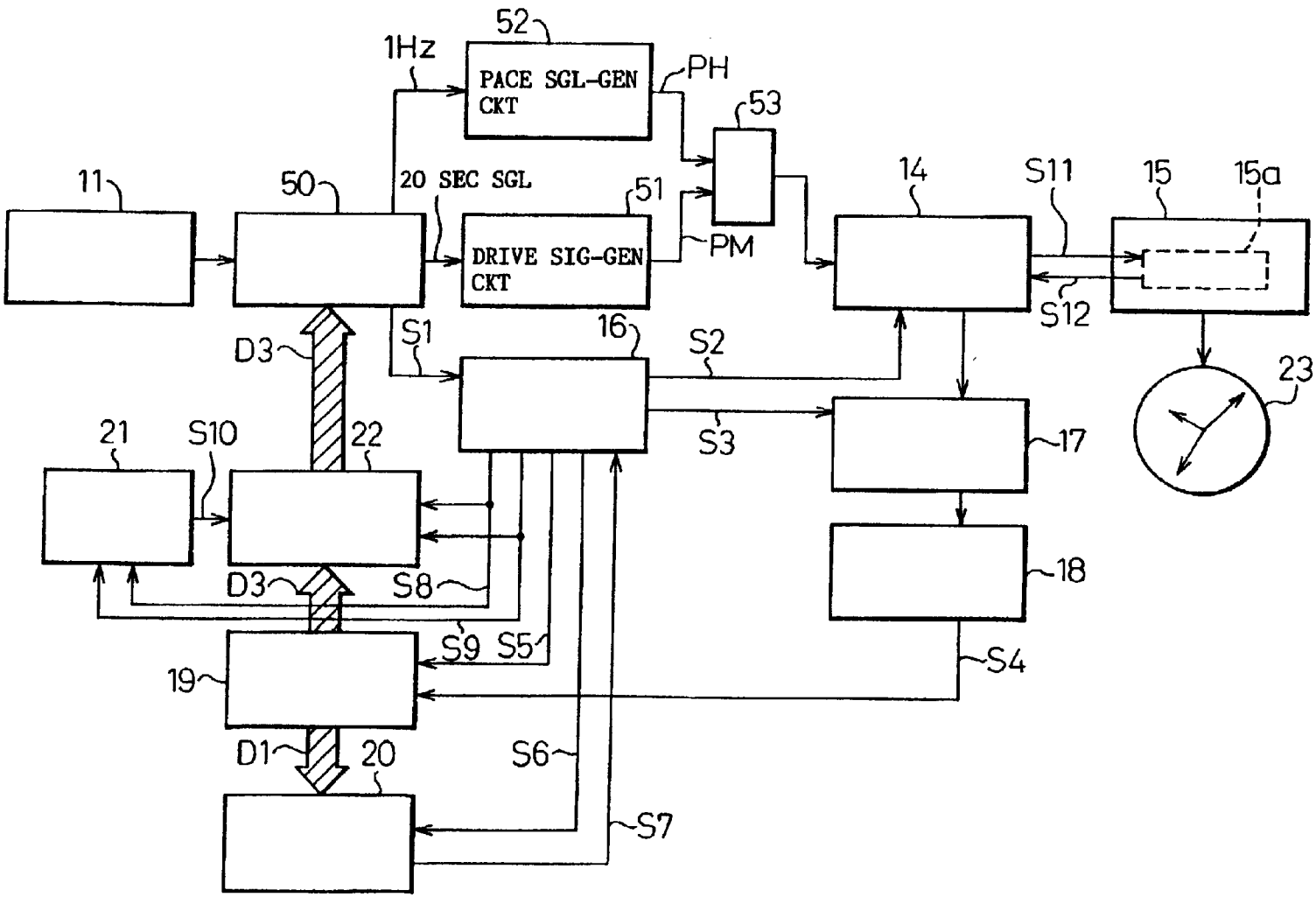
FIG. 5 is a block diagram illustrating major constituent portions in the wrist-type electronic timepiece according to a second embodiment of the present invention.

FIG. 5 is a block diagram of the circuit of the wrist-type electronic timepiece 1 according to the second embodiment of the present invention. This embodiment deals with a dress watch having hour and minute hands only. In the case of a timepiece having two hands, the motor drive pulse is output every after 20 seconds. When a conventional pace measuring means is used, therefore, the measuring time becomes too long.

Accordingly, provision is made of a pace signal-generating circuit 52 which inputs a 1-Hz signal from a frequency-dividing circuit 50 and outputs a pace measuring pulse PH of such a pulse width that does not drive the pulse motor maintaining a period of one second, in order to shorten the measuring time. According to this embodiment, the pace measuring pulse PH output from a pace signal-generating circuit 52 is used as a timing signal TM instead of using the motor drive pulse PM output from a drive signal-generating circuit 51 maintaining a period of 20 seconds.

In FIG. 5, the same reference numerals as those of FIG. 2 denote the same constituent members and their description is not repeated here.

Figure 6:
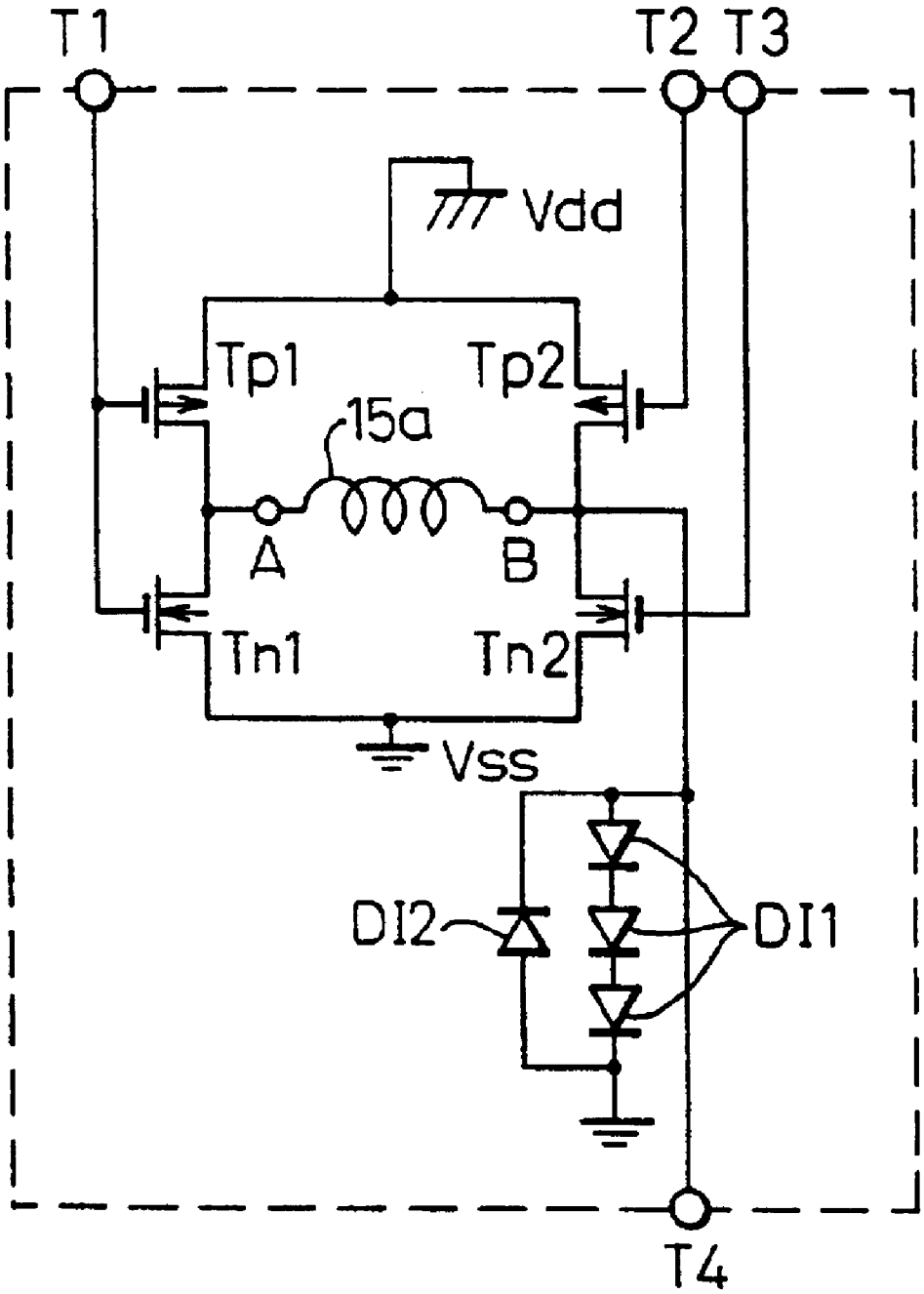
FIG. 6 is a diagram illustrating the constitution of a converter-driving circuit 14 in the wrist-type electronic timepiece 1 according to the present invention.

FIG. 6 is a diagram illustrating a concrete constitution of the hand-driving circuit in the wrist-type electronic timepiece 1 according to the above-mentioned first and second embodiment of the present invention.

Symbols Tp1, Tp2, Tn1 and Tn2 denote driving MOS transistors which are controlled by a motor drive pulse PM output from the drive signal-generating circuit 13. Symbols D11 and D12 denote diodes which work to clamp and shape a signal received by the hand-driving coil 15*a*, and output it to the gate circuit 17.

Described below is the operation of the thus constituted hand-driving circuit 14.

In an ordinary hand-moving state, a voltage is applied across points A and B of the hand-driving coil 15*a* to move the hands when Tp1 and Tn2 are turned off and Tn1 and Tp2 are turned on, or when Tn1 and Tp2 are turned off and Tp1 and Tn2 are turned on. In an ordinary state, furthermore, Tp1 and Tp2 are turned off, and Tn1 and Tn2 are turned on, so that Vss is applied across the points A and B of the hand-driving coil 15*a*.

In this state, when a reception possible signal S2 is input from the control signal-generating circuit 16, Tn1 is turned on, and Tn2, Tp1 and Tp2 are turned off, whereby the point A of the hand-driving coil 15*a* falls to the GND potential (Vss) and the point B floats. Therefore, the hand-driving coil 15*a* works as a receiving coil and receives the signal S28 transmitted from the transmission/reception device 2. The received signal at the point B is clamped and shaped by the diodes D11 and D12, and is sent to the gate circuit 17.

According to the embodiment of the present invention, as will be obvious from the foregoing description, the hand-driving coil in the wrist-type electronic timepiece also works to receive signals from the external unit. Therefore, the data can be transmitted and received in an ordinary hand-moving state without halting the operation of the timepiece during the operation of the functions. Unlike the prior art, therefore, there is no need of adjusting the time after the operations of the functions have been finished, and the user will find it very easy to use. This is also very advantageous from the standpoint of production.

Embodiment 3

A further example of the data transmission/reception system of the present invention will be described below, in detail, as embodiment 3 with reference to FIGS. 7 and 8.

When the second data signal transmitted from the data transmission/reception device is being received by the side of the electronic timepiece in the step of transmitting and receiving the first data signal or the second data signal according to the above-mentioned embodiments, the electric power is wastefully consumed and undesired noise is picked up in large amounts if the reception permit state is set to be unnecessarily long in the electronic timepiece. According to this embodiment, therefore, the reception possible period of the receiving means in the electronic timepiece is set to a short state of waiting for reception in order to decrease the consumption of electric power and to decrease the probability picking up noise, and the reception possible time is lengthened within a required range during the period of receiving the second data signal.

That is, the data transmission/reception system constituted according to this embodiment is provided with a permit time varying means 118 which is capable of arbitrarily varying the time for permitting the reception of the second data signal transmitted from the data transmission/reception device 2 after the timing signal TM is generated on the side of the electronic timepiece 1. The permit time varying means 118 includes a data detection permitting means 14*b* that permits the passage of the second data signal, and the control signal-generating circuit 16 that outputs a signal for changing the time width of the data detection permitting means 14*b*.

That is, provision is made of the data signal detection permitting means 14*b* which permits the electronic timepiece to receive the second data signal only for a predetermined reception possible time.

According to this embodiment, the reception possible time is set to be short when, for example, the electronic timepiece 1 is in a state of waiting for the reception and is set to be long when the electronic timepiece 1 is in a receiving state.

The fundamental constitution of this embodiment is nearly the same as the data transmission/reception system constitution of FIGS. 1 to 3, and the circuit constitution in the data transmission/reception device 2 is the same as that of FIG. 3 though the circuit in the electronic timepiece 1 contains some portions which are different from those of FIG. 2. Described below with reference to FIG. 7 therefore is the circuit constitution of the electronic timepiece 1 giving importance to the different portions only.

According to this embodiment, a data reception system 100 constituted by an electronic timepiece 1 comprises a data transmission/reception device 2 for generating data signals, a reference oscillation circuit 11, a drive signal-generating circuit 13 for generating motor drive pulses, a hand-driving circuit 14*a*, a hand drive 15 driven by the output signal S11 of the hand-driving circuit 14*a*, and a hand-driving device 23, and the hand-driving coil 15*a* constituting the hand drive 15 is utilized to receive the second data signal from the data transmission/reception device 2, the improvement wherein the electronic timepiece 1 is provided with a transmission/reception change-over circuit 119 for receiving the second data signal from the data transmission/reception device 2, a judging circuit for judging the presence or absence of data signal from the data transmission/reception device 2, and a control signal-generating circuit 16 which supplies a control signal to the transmission/reception change-over circuit 119, wherein said control signal-generating circuit 16 outputs a first control pulse S102 at a timing different from said motor drive pulse PM to place the transmission/reception change-over circuit 119 in the receiving state for a short period of time and outputs a second control pulse S103 in response to a reception judge signal from the judging circuit 20 to continuously place the transmission/reception change-over circuit 119 in the receiving state following said first control pulse S102, so that the signal transmitted from the data transmission/reception device 2 is received during the period in which the first control pulse S102 and the second control pulse S103 are being generated.

The electronic timepiece 1 is further provided with a motor drive pulse storage circuit 117 for storing a motor drive pulse PM that is generated while the second control pulse S103 is being output, so that the hands are quickly moved and corrected according to the data stored in the hand drive pulse storage circuit 117 after the second control pulse S103 has been output.

Figure 7:
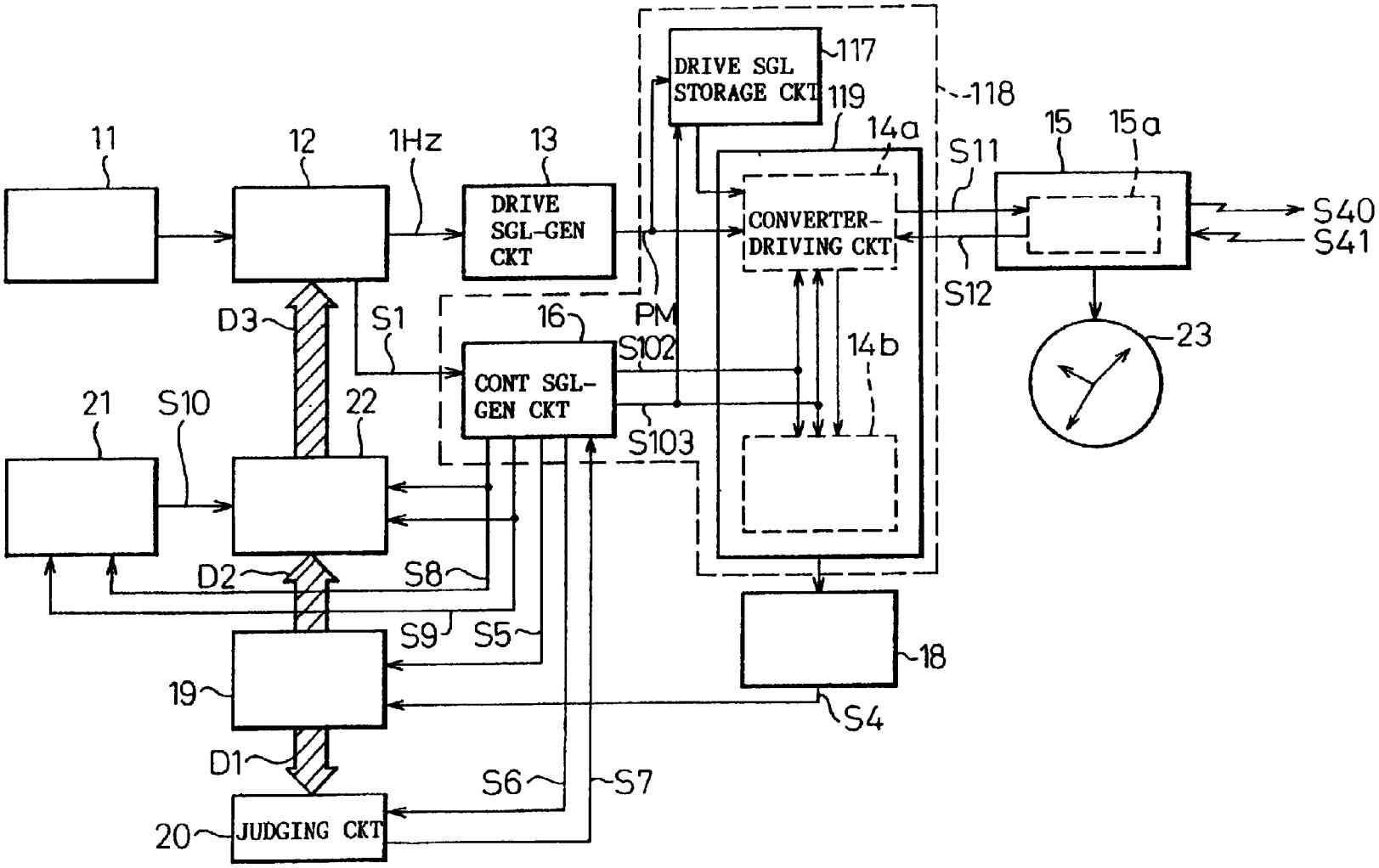
FIG. 7 is a block diagram illustrating major constituent portions in the wrist-type electronic timepiece according to a third embodiment.

FIG. 7 is a block diagram of the circuit of the wrist-type electronic timepiece 1 according to this embodiment, wherein reference numeral 11 denotes an oscillation circuit which uses a quartz oscillator to generate reference signals, and 12 denotes a frequency-dividing circuit which inputs oscillation signals from the oscillation circuit 11 and outputs a 1-Hz signal as a timepiece signal and a frequency-divided signal S1.

Reference numeral 13 denotes a drive signal-generating circuit which receives the 1-Hz signal from the frequency-dividing circuit 12 and outputs the motor drive pulse PM to the hand-driving circuit 14*a*. Reference numeral 15*a* denotes a hand-driving coil provided for the hand drive 15 to drive the hand-driving device 23. The hand-driving coil 15*a* also works for transmitting and receiving data to, and from, the pace adjusting device 2 which is the data transmission/reception device.

According to this embodiment, the hand drive-driving signal S11 fed to the-hand-driving coil 15*a* becomes a timing signal TM in transmitting and receiving the data to, and from, the pace adjusting device 2. Accordingly, the drive signal-generating circuit 13 also works as a timing signal-generating circuit. Upon receipt of the motor drive pulse PM, the hand-driving coil 15*a* generates a first data signal S40 in synchronism with the timing signal S11.

Reference numeral 16 denotes the control signal-generating circuit which, upon receipt of the frequency-divided signal S1, outputs many control signals, such as the first reception possible signal S102 which is the first control pulse, and the second reception possible signal S103 which is the second control pulse, to place the hand-driving circuit 14*a* in the receiving state. Reference numeral 14*b* denotes the reception permitting circuit which inhibits or permits the passage of the signal S12 received from the hand-driving coil 15*a* depending upon the first reception possible signal S102 and the second reception possible signal S103 from the control signal-generating circuit 16.

The reception permitting circuit 14*b* and the hand-driving circuit 14*a* constitute the transmission/reception change-over circuit 119 that transmits and receives data to, and from, the data transmission/reception device 2 which is the pace adjusting device. Reference numeral 117 denotes a drive signal storage circuit that stores the motor drive pulse PM generated while the second reception possible signal S103 is being output from the control signal-generating circuit 16, and quickly moves and corrects the hands according to the data stored in the drive signal storage circuit 117 after the second reception possible signal S103 has been output.

Reference numeral 18 denotes a pace adjust signal-detecting circuit which converts the signal S12, received from the hand-driving coil 15*a* and passing through the reception permitting circuit 14*b*, into apace adjust signal S4. Reference numeral 29 denotes a shift register which stores the pace adjust signal S4 from the pace adjust signal-detecting circuit 18 in response to a data shift signal S5 from the control signal-generating circuit 16, and outputs a data signal D1 and a data signal D2. Reference numeral 20 denotes a judging circuit which judges whether the data signal D1 has been stored in the shift register 19, i.e., whether the data has been transmitted from the pace adjusting device 2 in response to the data judge signal S6 output from the control signal-generating circuit 16. When the data has been transmitted, the judging circuit 20 sends a data rewrite permit signal S7 to the control signal-generating circuit 16. Upon receipt of the data rewrite permit signal 57, the control signal-generating circuit 16 outputs the second reception possible signal S103 to continuously place the transmission/reception change-over circuit 119 in the receiving state.

According to this embodiment, the constitution of the data transmission/reception device 2 is the same as the constitution of Embodiments 1 and 2 shown in FIG. 3, and is not described here.

Operation of the data reception system of the wrist-type electronic timepiece 1 equipped with the thus constituted pace adjusting function will now be described with reference to the time chart in FIG. 8. In an ordinary operation of the wrist-type electronic timepiece 1, the drive signal-generating circuit 13 receives a 1-Hz signal from the frequency-dividing circuit 12 and outputs if a motor drive pulse PM which also serves as a timing id signal for transmission and reception. The hand-driving circuit 14*a* receives the motor drive pulse pM and feeds the hand drive signal S11 to the hand-driving coil 15*a* whereby the hand drive 15 energizes the hand-driving device 23 to display the time while effecting the one-second hand movement. At the same time, the hand-driving coil 15*a* generates a timing signal TM or a first data signal S40 which contains the timing signal.

After the one-second hand movement is finished, the control signal-generating circuit 16 receives the frequency-divided signal S1 from the frequency-dividing circuit 12 and outputs a first reception possible signal S102 to change the hand-driving circuit 14*a* over to the receiving state, such that an electromagnetic adjust signal or the second data signal S41 from the pace adjusting device 2 is received by the hand-driving coil 15*a*. At the same time, the reception permitting circuit 14*b* is rendered to permit the passage of the reception signal S12.

Under this condition, however, the data has not yet been transmitted from the pace adjusting device, 2, and the judging circuit 20 does not output the data rewrite permit signal S7. Therefore, the control signal-generating circuit 16 ceases to output the first reception possible signal S102 and no longer outputs the second reception possible signal S103 for maintaining the receiving state.

Hereinafter in the same manner, the control signal-generating circuit 16 outputs the first reception possible signal S102 after every one-second hand movement by the motor drive pulse PM. When no data is transmitted from the pace adjusting device 2 during the period of the first reception possible signal S102, however, the control signal-generating circuit 16 does not output the second reception possible signal S103 for maintaining the receiving state but operates as an ordinary timepiece moving the hands every second.

In order to receive the first data signal S40 from the wrist-type electronic timepiece 1, on the other hand, the pace adjusting device 2 which is the data transmission/reception device is initialized upon manipulating the switch 38. When the switch 38 is manipulated, the start-of-measurement storage circuit 37 outputs the system clear signal S22 and the reception permit signal S23. The system clear signal S22 changes the transmission/reception change-over circuit 32 over to the reception mode to be able to receive the reference electromagnetic signal S4 from the wrist-type electronic timepiece 1. In response to the system clear signal S22, at the same time, the rewrite command-forming circuit 43 outputs a signal D7. The reception permit signal S23 from the start-of-measurement storage circuit 37 controls the gate circuit 33 to permit the passage of the first data signal S40 which is a timing signal TM from the transmission/reception coil 31. When the first data signal S40 which is the timing signal of the wrist-type electronic timepiece 1 is received in this state, the received signal is input to the pace signal-detecting circuit 34 passing through the gate circuit 33, whereby the pace signal-detecting circuit 34 processes the first data signal S40 that is received and outputs a pace detect pulse PT which is the first timing signal (timing t1 in the time chart of FIG. 8). The period-measuring circuit 35 starts counting the reference signals S13 from the reference signal-generating circuit 36 from a moment t1 when the first pace detect pulse PT1 is input.

Then, as the first data signal S40, which is a next timing signal, is output from the wrist-type electronic timepiece 1 and is received by the transmission/reception coil 31 causing the pace signal-detecting circuit 34 to output a second pace detecting pulse PT2 (timing t2 in the time chart of FIG. 8), then, the period-measuring circuit 35 ceases to count the reference signals S13 and outputs a measurement data D4. At the same time, upon receiving the second pace detect pulse PT2, the transmission/reception control circuit 39 which is the reception timing signal-generating means sends an operation instruction signal S24 to the pace adjusting amount operation circuit 41 which then starts calculating the pace adjusting amount. When the calculation is finished, the pace adjusting amount operation circuit 41 outputs the adjusting amount data D5 and further outputs an operation end signal S25 to the transmission/reception control circuit 39. The adjusting amount data D5 output from the pace adjusting amount operation circuit 41 is converted by the transmission data-forming circuit 42 into a data signal D6 of the form of binary code. Furthermore, the adjusting amount data D5 is converted into a daily variation through the display circuit 45 and its value is displayed on the display unit 46.

Then, as the first data signal S40 output from the wrist-type electronic timepiece 1 is received by the transmission/reception coil 31 causing a third pace detect pulse PT3 to be output from the pace signal-detecting circuit 34 (timing t3 in the time chart of FIG. 8), the transmission/reception control circuit 39 that is inputting the pace detect pulse PT3 outputs the latch signal S26, and the signal D7 and the data signal D6 are stored in the data transfer circuit 44. Moreover, a change-over signal S21 is output in synchronism with the pace detect pulse PT3 (t4 in the time chart of FIG. 8), and the transmission/reception change-over circuit 32 is set to the transmitting state. Then, the ID signal D7 and the data signal D6 stored in the data transfer circuit 44 are successively output as transmission signals S28 in response to a clock signal S27 from the clock-generating circuit 40 that operates in response to the start signal that is output next from the transmission/reception control circuit 39. The transmission signal S28 is transmitted through the transmission/reception change-over circuit 32 and the transmission/reception coil 31 to the wrist-type electronic timepiece 1 as an electromagnetic adjust signal S41, i.e., as a second data signal. After the transmission signals S28 are transmitted, the transmission/reception control circuit 39 outputs a transmission end signal S30. The timings for transmitting the above series of transmission signals S28 are in agreement with the state of outputting the change-over signal S21 and outputting the first reception possible signal S102 from the control signal-generating circuit L6 of the wrist-type electronic timepiece 1 in the time chart of FIG. 8, i.e., in agreement with the receiving state of the wrist-type electronic timepiece 1. The transmission end signal S30 from the transmission/reception control circuit 39 is input to the start-of-measurement storage circuit 37. As the start-of-measurement storage circuit 37 is reset, the reception permit signal S23 is no longer output, and the gate circuit 33 is closed (timing t7 in the time chart of FIG. 8). Thus, one pace adjusting operation is finished. When it is desired to carry out the pace adjusting operation again, the switch 38 must be depressed.

On the other hand, the second data signal S41 transmitted from the pace adjusting device 2 is received by the hand-driving coil 15*a* of the wrist-type electronic timepiece 1. The operation will be described hereinbelow.

In the wrist-type electronic timepiece 1 as described earlier, the transmission/reception change-over circuit 119 is changed over to the receiving state in response to the first reception possible signal S102 output from the control signal-generating circuit 16, and waits for the second data signal S41 that will be transmitted from the pace adjusting device 2.

When the second data signal S41 is transmitted from the pace adjusting device 2, the signal S41 constituted by the signal D7 and the data signal D6 is received as a reception signal S12 by the hand-driving coil 15*a* at a timing of the first reception possible signal S102. The reception signal S12 is then detected by the pace adjust signal-detecting circuit 18 via the reception permitting circuit 14*b*, and is output as a pace adjust signal S4 and is then successively stored in the shift register 19 in response to a data shift signal S5 output from the control signal-generating circuit 16. As the stored pace adjust signal S4 corresponds to the signal D7 sent from the pace adjusting device 2, the ID signal D7 is output as a data signal D1 to the judging circuit 20.

At this moment, the control signal-generating circuit 16 outputs a data judge signal S6 to the judging circuit 20 which then judges whether the data signal D1 is present or not. When there is no data signal D1, the data rewrite permit signal S7 is not output. Therefore, the control signal-generating circuit 16 does not output the second reception possible signal S3 that continuously places the transmission/reception change-over circuit 119 in the receiving state, and the pace adjustment is not carried out.

Figure 8:
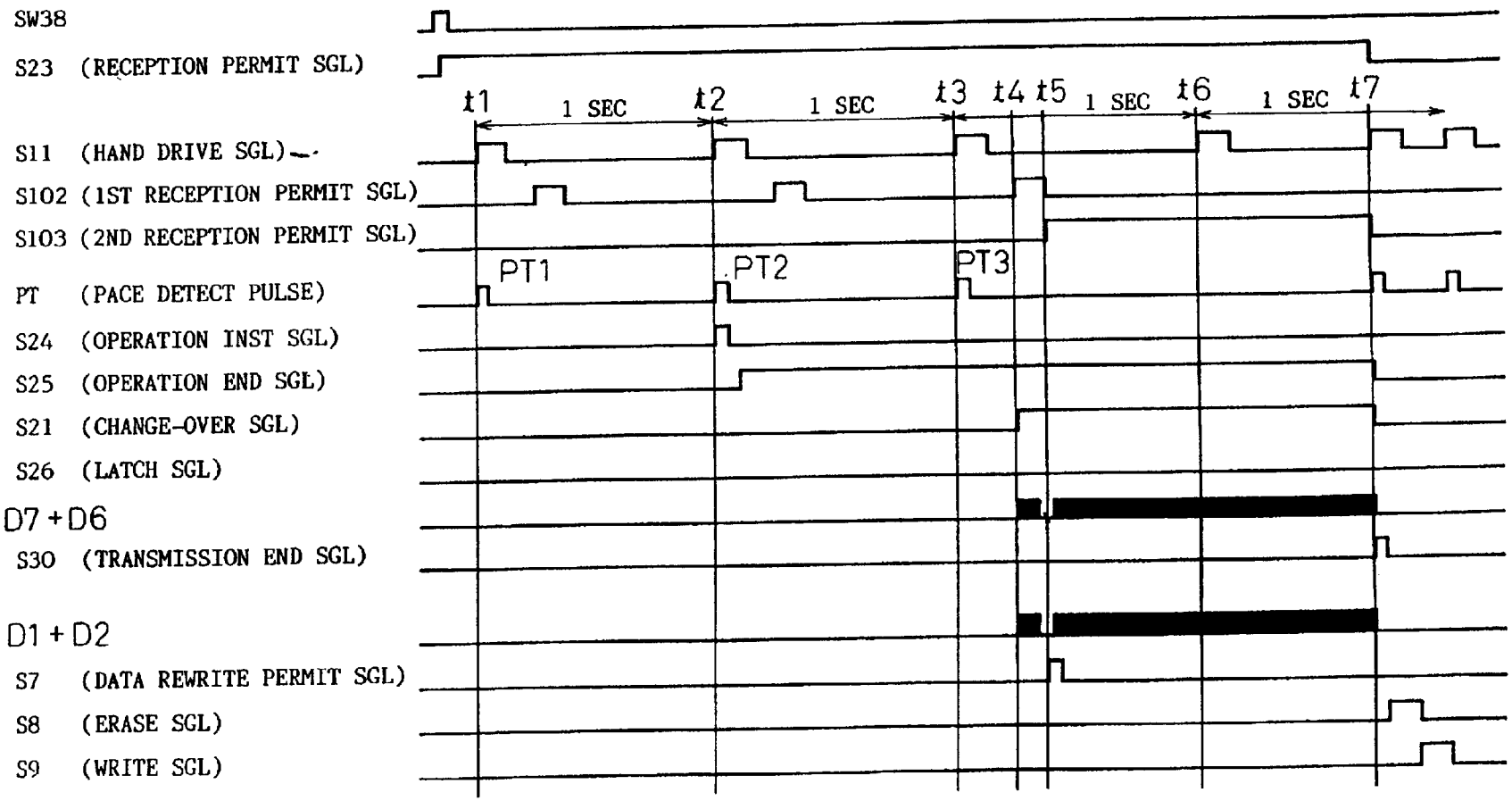
FIG. 8 is a time chart for explaining the operation of the third embodiment of the present invention.

The judging circuit 20 outputs the data rewrite permit signal S7 when there is a data signal D1 (timing t5 in the time chart of FIG. 8). Accordingly, the control signal-generating circuit 16 outputs a second reception possible signal S103 to continuously place the transmission/reception change-over circuit 14 in the receiving state and, at the same time, outputs the data shift signal S5, so that the pace adjust signal S4 corresponding to the data signal D6 transmitted from the pace adjusting device 2 is stored in the shift register 19.

In response to the second reception possible signal S103, the drive signal storage circuit 117 starts storing the motor drive pulse PM. Here, the motor drive pulse was been stored at the moment t6 in the time chart of FIG. 8. As the time passes in which the electromagnetic adjust signals S41 transmitted from the pace adjusting device 2 are received, the control signal-generating circuit 16 ceases to output the second reception possible signal S103, liberates the transmission/reception change-over circuit 14 from the receiving state, and, at the same time, quickly moves and corrects the hands according to the data stored in the drive signal storage circuit 117 (timing t7 in the time chart of FIG. 8). Then, the control signal-generating circuit 16 outputs an erase signal S8 to set the pace adjusting amount storage circuit 22 which is the system memory to the erase mode and, at the same time, to operate the booster circuit S21, so that the data in the pace adjusting amount storage circuit 22 is erased by a boosted signal S10. The control signal generating circuit 16 then outputs a write signal S9 to set the pace adjusting amount storage circuit 22 to the write mode and, at the same time, to operate the booster circuit 21 thereby to write the data signal D2 which is the adjusting amount data onto the pace adjusting amount storage circuit 22. The adjustment of pace is thus finished.

According to this embodiment, as will be obvious from the foregoing description, the hand-driving coil in the wrist-type electronic timepiece is also utilized as a reception coil for receiving signals from the external unit, a state of waiting for the reception of a minimum period of time is provided, the receiving state is established when the signal received in this state is a proper signal and whereby data signals are received while preventing erroneous operation that may be caused by disturbance. Furthermore, 1-Hz signals generated while the pace is automatically adjusted are stored and are used for quickly moving and correcting the hands after the pace is automatically adjusted. It is thus offers a highly reliable wrist-type electronic timepiece to the users and presents great advantages from the standpoint of production.

The foregoing embodiments have dealt with the cases of executing the so-called pace adjustment for adjusting the time of the electronic timepiece. As mentioned earlier, however, it will become necessary to carry out predetermined adjusting operations for a variety of functions possessed by a multi-functional electronic timepiece.

Therefore, the data transmission/reception system for the electronic timepiece of the present invention must have a mechanism that makes it possible to easily carry out the adjusting operations as a matter of course.

According to the present invention, therefore, the first signal output from the electronic timepiece is used as a characteristic data signal related to the electronic timepiece. In this embodiment, furthermore, the electronic timepiece is provided with a characteristic data-generating means 137 which generates the characteristic data signal and a storage means for storing the characteristic data setting value.

According to this embodiment, furthermore, the data transmission/reception device 2 has a characteristic data signal-detecting means for detecting the characteristic data signal output from the electronic timepiece 1 and a data signal-forming means for forming, in response to the characteristic data signal, a characteristic data signal setting value that serves as a second data signal which will be transmitted to the electronic timepiece. The characteristic data signal is one which is selected from an acoustic signal, a pressure characteristic signal, a temperature signal and the like signals.

When the characteristic data signal is a pressure signal, then the characteristic data signal-detecting means is a pressure signal-detecting means for detecting the pressure signal in an environment where the electronic timepiece is placed, the characteristic data-setting means is a pressure-setting means, and the data signal-forming means is a pressure setting data-forming means.

When the characteristic data signal is a temperature signal, the characteristic data signal-detecting means is a temperature signal-detecting means for detecting the temperature in an environment where the electronic time piece is placed, the characteristic data-setting means is a temperature-setting means, and the data signal-forming means is a temperature setting data-forming means.

Embodiment 4

A further embodiment of the data transmission/reception system using the electronic timepiece according to the present invention will be described next with reference to FIGS. 9 to 12.

This embodiment deals with an electronic timepiece having an acoustic function with reference to FIGS. 9 to 12 and in which the sound volume-adjusting operation is carried out by detecting an acoustic signal, i.e., a sound volume signal, output from the acoustic device.

In the conventional electronic timepieces having an acoustic function, the sound volume may decrease depending upon the structure of the timepiece case even if the sound volume is set constant in the timepiece module. The sound volume can be adjusted by providing an IC with a CR oscillator that sets a sounding frequency and adjusting the sounding frequency in an analog manner by using a trimmer capacitor or a trimmer resistor such that the sound volume becomes a maximum depending upon the structure of the individual timepiece case. According to Japanese Unexamined Utility Model Publication (Kokai) No. 5-2575, there has been proposed an electronic timepiece with a notifying function in which a sounding frequency that makes the sound volume maximum is digitally set and the thus set value is stored.

Even if a maximum sound is accomplished in the stage of module according to the above system, however, the sound volume changes when the back is closed. It therefore becomes necessary to set the maximum sound by repeating the adjustment, i.e., adjusting the sound volume while the back is open, closing the back to test the sound volume, and repeating this operation. This embodiment is to eliminate the above-mentioned defect, and provides an electronic timepiece with acoustic function which is capable of setting a sound frequency that produces the maximum sound volume in the finished timepiece without the need of attaching and detaching the back.

In order to accomplish the above-mentioned object, the constitution according to this embodiment comprises an electronic timepiece 1 having an acoustic function and a sound volume-adjusting device 2 for adjusting the sound volume of the electronic timepiece, wherein the electronic timepiece 1 has an acoustic device 137, a sound volume-adjusting circuit that changes the signals supplied to the acoustic device, and an input means for inputting a control signal from the sound volume-adjusting circuit, thereby to output acoustic signals that change successively, and the sound volume-adjusting device has a microphone 6 which is a sound-detecting means, a sound volume setting data-forming means, and an output means, thereby to detect different acoustic signals from the electronic timepiece, to judge an optimum sound volume and to output a judgement signal thereof. Depending upon the judgement signal input to the input means from the sound volume-adjusting device, the electronic timepiece sets an optimum sound signal to the sound volume-adjusting circuit.

Figure 9:
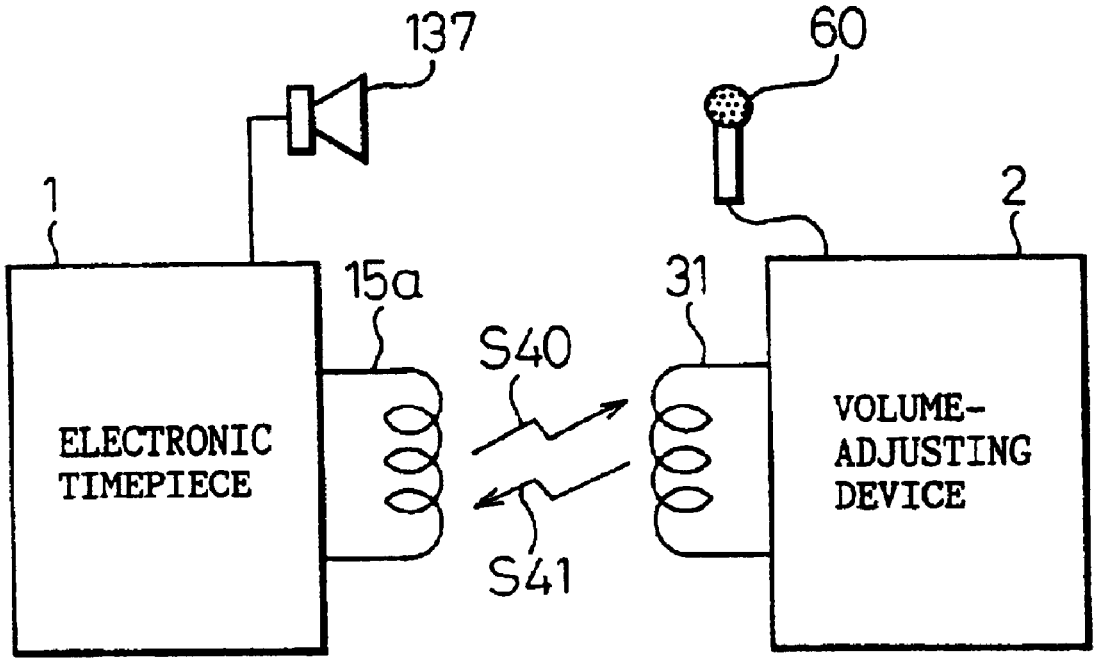
FIG. 9 is a block diagram of a data transmission/reception system comprising an electronic timepiece having an acoustic function and a sound volume-adjusting device according to a fourth embodiment of the present invention.

Constitution of this embodiment will now be described with reference to the drawings. FIG. 9 is a block diagram of a system for adjusting the sound volume of an electronic timepiece equipped with an acoustic function according to this embodiment. The fundamental constitution is the same as that of FIG. 1, and wherein reference numeral 1 denotes an electronic timepiece equipped with a hand-driving coil 15*a* for driving the hands and an acoustic device 137. Reference numeral 2 denotes a sound volume-adjusting device which is a data transmission/reception device and is equipped with a transmission/reception coil 31 and a microphone 60 which is the sound-detecting device. The transmission/reception coil 31 transmits and receives data to, and from, the hand-driving coil 15*a*.

The microphone 60 works to detect the sound from the acoustic device 137. The sound volume-adjusting device 2 transmits, to the hand-driving coil 15*a*, the sound volume setting data which is a second data signal in the form of an electromagnetic setting signal S41 in response to the timing signal S40 every time when the electromagnetic timing signal that is the first data signal transmitted from the hand-driving coil 15*a* of the electronic timepiece 1 is received by the transmission/reception coil 31. That is, the sound volumes output from the acoustic device 137 are successively measured, a maximum sound volume is judged depending upon the measured result, and a sound volume setting data which sets a maximum sound volume is transmitted as the electromagnetic setting signal S41 to the hand-driving coil 15*a* in synchronism with the timing signal S40.

Figure 10:
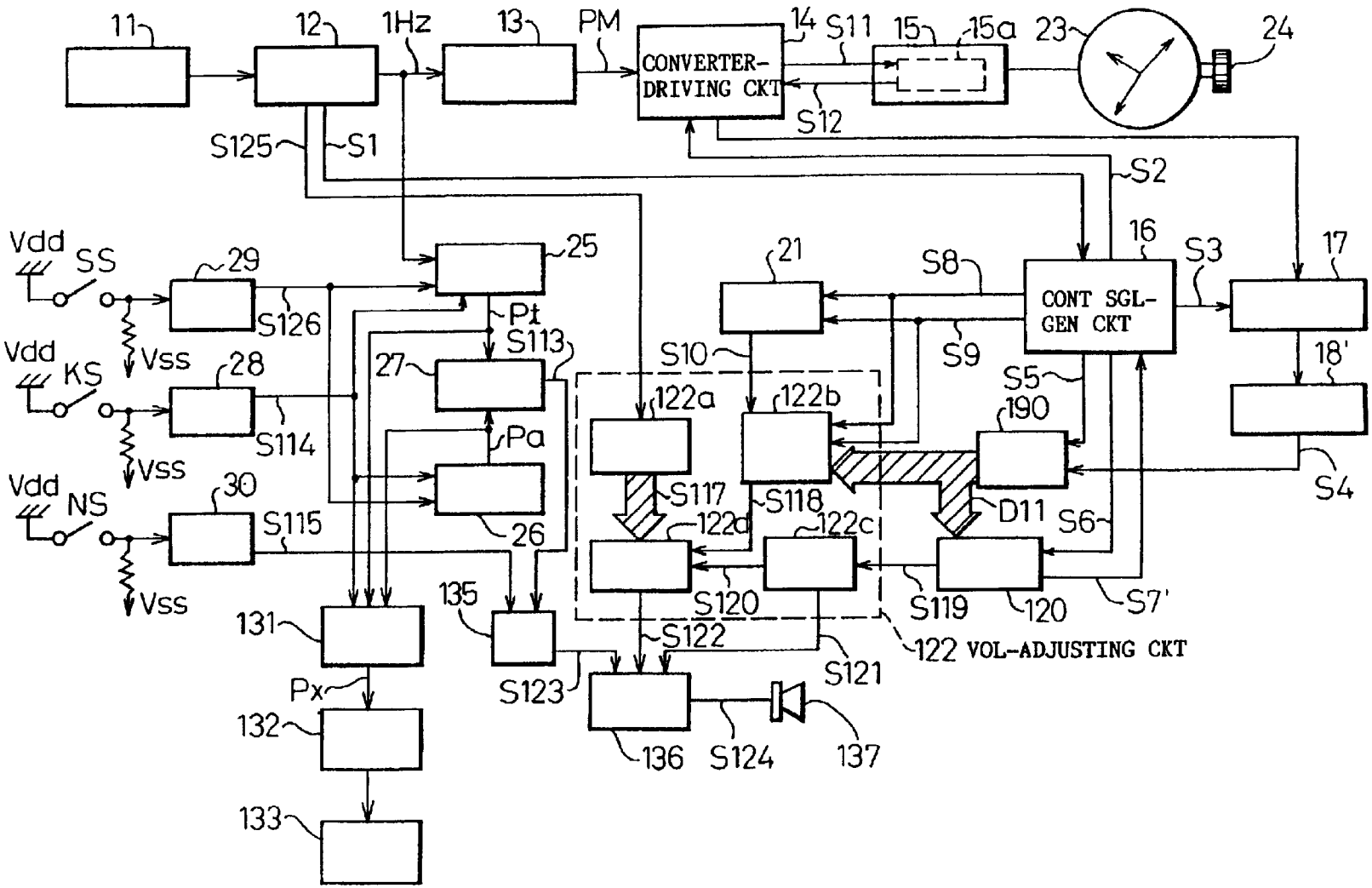
FIG. 10 is a block diagram illustrating major constituent portions in the electronic timepiece of FIG. 9.

FIG. 10 is a block diagram illustrating the circuit of the electronic timepiece 1 according to this embodiment, wherein reference numeral 11 denotes an oscillation circuit employing a quartz oscillator to generate reference signals, 12 denotes a frequency-dividing circuit which receives oscillation signals from the oscillation circuit 11 and outputs frequency-divided signals S1, S125 and a 1-Hz signal, and reference numeral 25 denotes a timepiece circuit which receives the 1-Hz signal from the frequency-dividing circuit 12, carries out the timepiece operation and outputs time data Pt.

Reference numeral 26 denotes a to-be-notified-time setting circuit which, when a time-notifying function is selected by a function selection circuit 28 that will be described later, sets a to-be-notified time in response to a correction signal S126 from a correction circuit 29 and, at the same time, outputs the thus set to-be-notified time as a to-be-notified-time data Pa.

Reference numeral 27 denotes a coincidence detecting circuit which compares the time data Pt with the to-be-notified-time data Pa and outputs a comparison signal S113. Reference numeral 28 denotes the function selection circuit which outputs a select signal S114 for selecting the timepiece function and the time-notifying function when a function selection switch KS is manipulated being linked to an external operation member, and 29 denotes the correction circuit which outputs a correction signal S126 for correcting the timepiece function or for correcting the time of the time-notifying function selected by the function selection circuit 28.

Reference numeral 30 denotes a selection circuit which is controlled by a sounding selection switch NS that is operated by an external operation member, and alternatingly outputs the sounding control signals S115 for controlling whether the time be notified or not when the time data Pt and the to-be-notified-time data Pa are in agreement as detected by the coincidence detecting circuit 27.

Reference numeral 131 denotes a display change-over circuit which inputs the time data Pt and the to-be-notified-time data Pa, selects one of them depending upon the select signal S114 of the function selection circuit 28, and outputs it as a display data Px, 132 denotes a decoder/driver circuit which inputs the display data Px and lets various function data to be displayed on a display unit 133, and reference numeral 135 denotes a gate circuit which inputs the sounding control signal S115 and the comparison signal S113, and outputs a sound output permit signal S123 which drives the acoustic device 137.

Reference numeral 13 denotes a drive signal-generating circuit which receives the 1-Hz signal from the frequency-dividing circuit 12 and outputs to the hand-driving circuit 14 a motor drive pulse PM as a timing signal for driving the hands, reference numeral 15*a* denotes a hand-driving coil provided for the hand drive 15 to drive the hand-driving device 23, the hand-driving coil 15*a* also working as a transmission/reception coil for transmitting and receiving data to, and from, the automatic sound volume-setting device 2.

In this embodiment, the hand drive-driving signal S11 fed to the hand-driving coil 15*a* serves as a timing signal sent to the sound volume-adjusting device 2 and, hence, the drive signal-generating circuit 13 also works as a timing signal-generating circuit. Reference numeral 24 denotes the crown for correcting the time.

Reference numeral 16 denotes a control signal-generating circuit which receives the frequency-divided signal S1 and outputs many control signals such as reception permit signal S2 and the like signals to place the hand-driving circuit 14 in the receiving state, and 17 denotes a gate circuit which inhibits or permits the passage of the signal S12 received from the hand-driving coil 15*a* depending upon the detection permit signal S3 output from the control signal-generating circuit 16.

Reference numeral 18' denotes a sound volume setting signal-detecting circuit which converts the reception signal that has passed through the gate circuit 17 into a sound volume setting signal S4', and 190 denotes a sound volume selection circuit which stores the sound volume setting signal S4' from the sound volume setting signal-detecting circuit 18' in response to the data shift signal S5 from the control signal-generating circuit 16, and outputs a sound volume setting data signal D11.

Reference numeral 120 denotes a data decoder which decodes the sound volume setting data signal D11 stored by the sound volume selection circuit 190 in response to the data judge signal S6 output from the control signal-generating circuit 16, feeds a test signal S119 to a control circuit 122*c* that will be described later and feeds the data rewrite permit signal S7' to the control signal-generating circuit 16, and reference numeral 21 denotes a booster circuit which executes the boosting operation in response to the erase signal S8 and the write signal S9 output from the control signal-generating circuit 16 in order to output a boosted signal S10 for only a predetermined period of time.

Reference numeral 122 denotes a sound volume-adjusting circuit which is constituted as described below. Reference numeral 122*a* denotes a volume signal-generating circuit which inputs a frequency-divided signal S125 from the frequency-dividing circuit 12 and forms a plurality of acoustic signals S117. Reference numeral 122*b* denotes an acoustic signal-setting circuit constituted by a nonvolatile memory or the like memory which receives a volume setting data signal D1 from the volume selection data-forming circuit 190 and a boosted signal S10 from the booster circuit 21, and from which data is erased or into which data is written by an erase signal S8 or a write signal S9 from the control signal-generating circuit 16, and then sends a sound volume select signal S118 to a selection circuit 122*d* that will be described later. Since the acoustic signal-setting circuit 122*b* is constituted by a nonvolatile memory or the like memory, the volume select data signal D1 stored therein is not erased but remains therein even when the cell is replaced. Reference numeral 122*c* denotes a control circuit which receives a test signal S119 from the data decoder 120, and feeds a select signal S120 for testing to the selection circuit 122*d* that will be described later and further feeds a monitor drive signal S121 to an acoustic drive circuit 136 that will be described later. Reference numeral 122*d* is the selection circuit which selects the acoustic signal S117 in response to the select signal S120 for testing from the control circuit 122*c* or the volume select signal S118 from the acoustic signal-setting circuit 122*b*, and outputs a sound signal S122. Reference numeral 136 is the acoustic drive circuit which inputs the sound signal S122 selected by the selection circuit 122*d* in response to the monitor drive signal S121 or the sound output permit signal S123 from the gate circuit 135, and outputs an acoustic drive signal S124 for driving the acoustic device 137.

Figure 11:
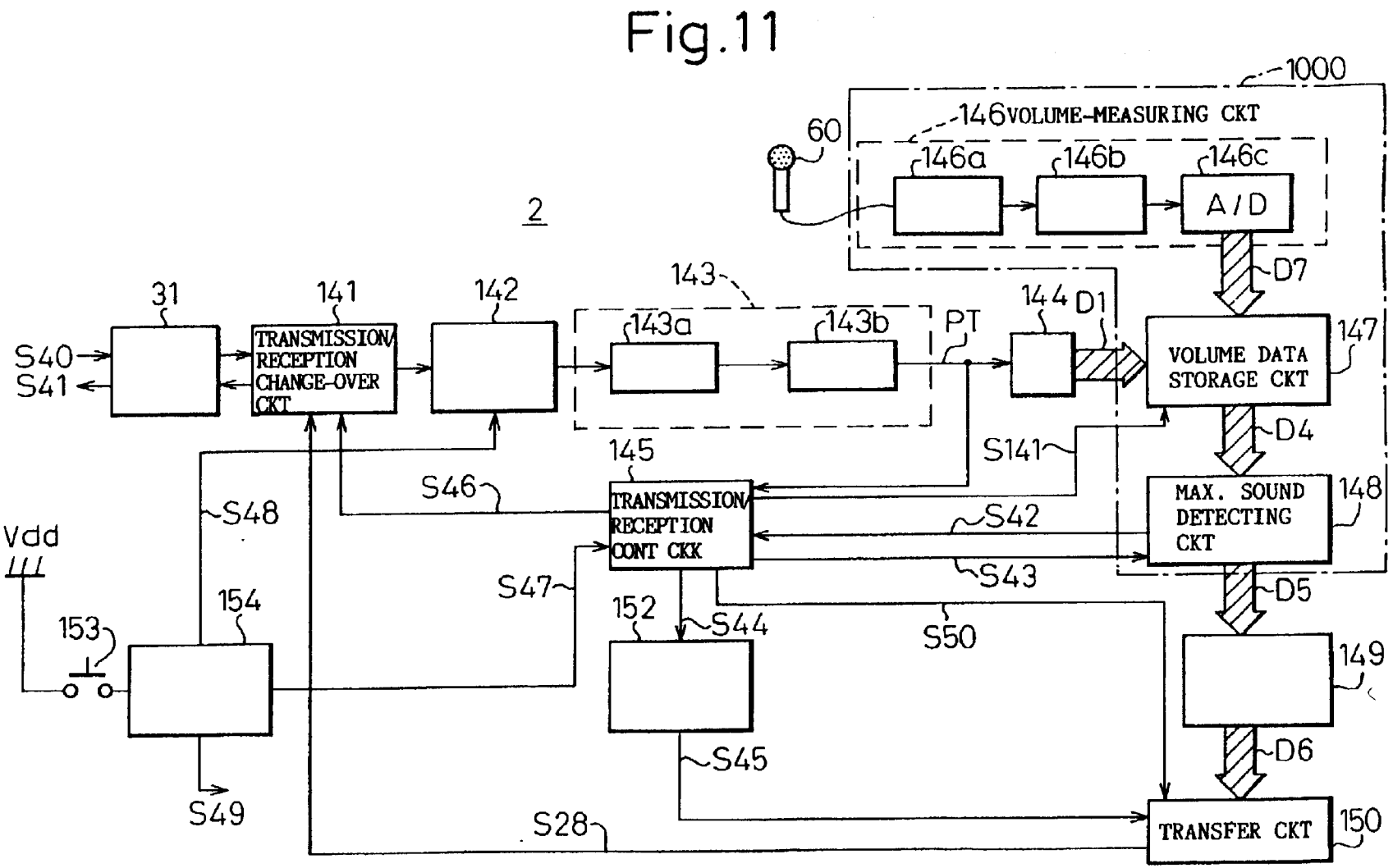
FIG. 11 is a block diagram illustrating major constituent portions in the sound volume-adjusting device of FIG. 9.

FIG. 11 is a block diagram illustrating the circuit of an automatic sound volume-setting device 2 which is used as a data transmission/reception device in this embodiment. The automatic sound volume-setting device 2 according to this embodiment receives through the transmission/reception coil 31 the first data signal S40 generated from the hand-driving coil 15*a* of the electronic timepiece 1, and detects the sound volume from the acoustic device 137 and measures it successively. Relying upon the result of measurement, the automatic sound volume-setting device 2 forms volume setting data which renders the sound volume of the electronic timepiece 1 a maximum, and transmits the volume setting data as the second data signal S41 to the hand-driving coil 15*a* in synchronism with the first data signal S40.

Reference numeral 31 denotes the transmission/reception coil, 141 denotes a transmission/reception change-over circuit which receives the timing signal from the hand-driving coil 15*a* and transmits the volume setting data to the hand-driving coil 15*a* in response to the change-over signal S46 from a transmission/reception control circuit 145 that will be mentioned later, 142 denotes a gate circuit which inhibits or permits the passage of the electromagnetic timing signal S40, and 143 denotes a received signal-detecting circuit which is constituted by a filter circuit 143*a* and an amplifier circuit 143*b*, receives the timing signal S40 from the gate circuit 142, and outputs it as a received signal detect pulse PT.

Reference numeral 154 denotes a start-of-measurement storage circuit which, when a switch 153 is manipulated, outputs a system clear signal S49 for initializing the sound volume-adjusting device 2 which is another form of the data transmission/reception device and further outputs the reception permit signal S48, so that the gate circuit 142 permits the passage of the timing signal from the hand-driving coil 15*a*. Reference numeral 145 denotes a transmission/reception control circuit which inputs the received signal detect pulse PT and outputs many control signals such as the change-over signal S46 which places the transmission/reception change-over circuit 141 in the transmitting state. Reference numeral 144 denotes an address counter which inputs the reception signal detect pulse PT and outputs an address data D1 for designating the address of the sound volume data storage circuit 147 that will be mentioned later.

Reference numeral 146 denotes a sound volume-measuring circuit constituted by a filter circuit 146*a*, an amplifier circuit 146*b* and an A-D converter circuit 146*c*, which receives an acoustic signal detected by the microphone 60 and outputs a volume measurement data D7 which has been converted into a digital signal. Reference numeral 147 denotes a volume data storage circuit which stores the volume measurement data D7 measured by the volume-measuring circuit 146 in a place designated by the address data D1 of the address counter 144, and successively outputs the measured data that have been stored as stored volume data D4 in response to read signals S141 from the transmission/reception control circuit 145.

Reference numeral 148 denotes a maximum sound-detecting circuit which inputs the stored volume data D4 and begins calculating a maximum sound volume out of the stored volume data D4 stored in the volume data storage circuit 147 in response to an operation instruction signal S43 from the transmission/reception control circuit 145. After the operation is finished, the address of the volume data storage circuit 147 storing the maximum sound volume is output as a volume setting data D5, and an operation end signal S42 is output to the transmission/reception control circuit 145. A volume setting data-forming means 1000 is constituted by the volume-measuring circuit 146, volume data storage circuit 147 and maximum sound-detecting circuit 148. Reference numeral 149 denotes a transmission data-forming circuit which inputs the volume setting data D5 from the maximum sound-detecting circuit 148 and converts it into a transmission data signal D6 of the form of a binary code.

Reference numeral 150 denotes a transfer circuit which receives the transmission data signal D6, is latched by a latch signal S50 output from the transmission/reception control circuit 145, and outputs a transmission signal S41 in which the transmission data signals D6 are arranged in series in response to clock signals S45 from the clock-generating circuit 152 which outputs a clock signal S45 for driving the transfer circuit 150 in response to the drive signal S44 output from the transmission/reception control circuit 145. The transmission end signal S47 output from the transmission/reception control circuit 145 resets the start-of-measurement storage circuit 154 to initialize the sound volume-adjusting device 2 and, at the same time, causes the gate circuit 142 to inhibit the passage of the timing signal from the hand-driving coil 15*a*.

Figure 12:
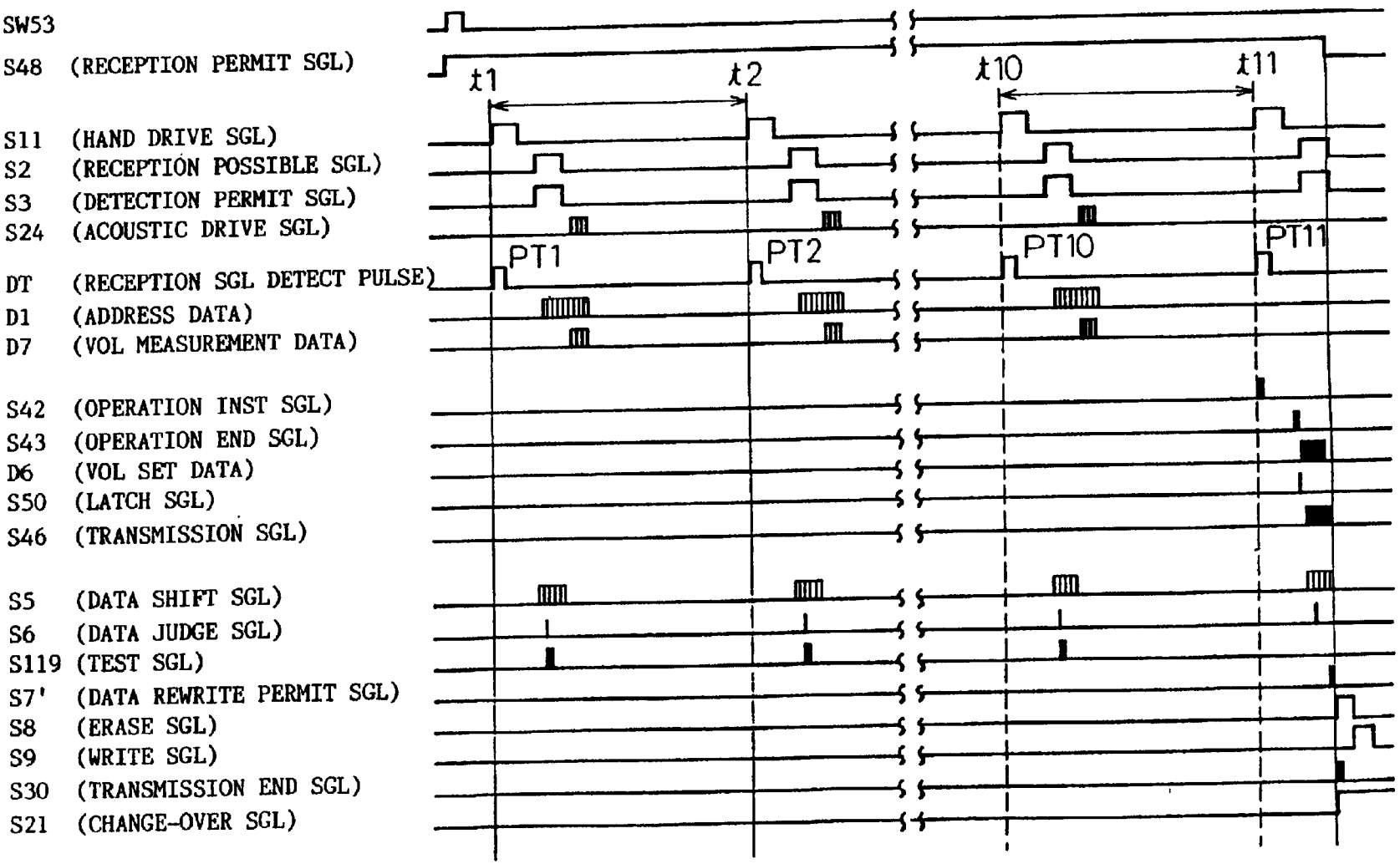
FIG. 12 is a time chart for explaining the operation of the fourth embodiment.

Described below is the operation of the thus constituted sound volume-adjusting system of the electronic timepiece 1 with reference to a time chart of FIG. 12. In an ordinary operation of the electronic timepiece 1, the drive signal-generating circuit 13 Ad1 receives the 1-Hz signal from the frequency-dividing circuit 12 and outputs the motor drive pulse PM which is a timing signal. The hand-driving circuit 14 receives the motor drive pulse PM and feeds the hand drive-driving signal S11 to the hand-driving coil 15*a* which then drives the hand-driving device 23 to display the time on the basis of one-second hand movement.

After the one-second hand movement, the control signal-generating circuit 16 receives the frequency-dividing signal S1 from the frequency-dividing circuit 12 and outputs the reception possible signal S2 which then changes the hand-driving circuit 14 over to receiving the transmission signal S41 from the data transmission/reception device 2 through the hand-driving coil 15*a*. At the same time, the control signal-generating circuit 16 outputs the detection permit signal S3 which causes the gate circuit 17 to permit the passage of the reception signal S12. The hand-moving operation is thus finished and the electronic timepiece 1 is maintained in the reception possible state for the period of the reception possible signal S2 before the next hand-moving operation.

In this reception possible state, the control signal-generating circuit 16 outputs the data shift signal S5, so that a volume setting signal S4' is stored in the volume selection data-forming circuit 190. The data decoder 120 decodes the volume select data signal D1 from the volume select data-forming circuit 190, and outputs the test signal S119 or the data rewrite permit signal S7'. At this moment, however, the data decoder 120 outputs the test signal S119 since no data has been received from the sound volume-adjusting device 2. The control circuit 122*c* feeds to the selection circuit 122*d* the select signal S120 for testing that is stepped up every time when the test signal S119 is input and, at the same time, feeds the motor drive signal S121 to the acoustic drive circuit 136. As a result, the sounding signal S122 selected by the selection circuit 122*d* is fed to the acoustic drive circuit 136, and sound is produced from the acoustic device 137.

To receive the timing signal from the electronic timepiece 1, on the other hand, the sound volume-adjusting device 2 is initialized upon the manipulation of the switch 153. Upon manipulating the switch 153, the start-of-measurement storage circuit 154 outputs the system clear signal S49 and the reception permit signal S48. The transmission/reception change-over circuit 141 is changed, by the system clear signal S49, over to the receiving state to receive the timing signal from the electronic timepiece 1. At the same time, the address counter 144 is initialized to designate address 0 of a sound volume data storage circuit 147 which stores the sound volume storage data D7. The reception permit signal S48 output from the start-of-measurement storage circuit 154 controls the gate circuit 142 to permit the passage of the timing signal from the transmission/reception coil 31.

The first data signal S40 from the electronic timepiece 1 that is received in this state is input to the reception signal-detecting circuit 143 passing through the gate circuit 142. The reception signal-detecting circuit 143 then detects a reception signal detect pulse PT1 which is the first timing signal (timing t1 in the time chart of FIG. 12). The address value of the address counter 144 is stepped up after a predetermined period of time has passed from the detection of the reception signal detect pulse PT1, and an acoustic signal output by the microphone 60 that has detected the sound produced by the acoustic device 137 of the electronic timepiece 1 is measured by the sound volume-measuring circuit 146 and the sound volume measurement data D7 is stored in the sound volume data storage circuit 147.

In response to the reception signal detect pulse PT11, the transmission/reception control circuit 145 outputs a control signal for calculating a maximum value from the measurement data stored in the sound volume data storage circuit 147. First, the read signal S41 is output to successively output the measurement data stored in the sound volume data storage circuit 147, and the operation instruction signal S43 is output to the maximum sound-detecting circuit 148 to calculate a maximum value from the measurement data. When the operation is finished, the maximum sound-detecting circuit 148 outputs the address of the sound volume data storage circuit which is storing the maximum sound volume value as the sound volume setting data D5 and further outputs the operation end signal S43 to the transmission/reception control circuit 145. The volume setting data D5 is converted into a transmission data signal D6 through the transmission data-forming circuit 149.

Upon receiving the operation end signal S43, the transmission/reception control circuit 145 outputs a latch signal S50 for storing the transmission data signal D6 in the transfer circuit 150. The transmission/reception control circuit 145, at the same time, outputs the change-over signal S46 to change the transmission/reception change-over circuit 141 over to the transmitting state. The transmission/reception control circuit 145 further outputs the start signal S44 to start the clock-generating circuit 152.

The clock-generating circuit 152 outputs the clock signal S45 for driving the transfer circuit 150. The transmission data S41 output from the transfer circuit 144 is transmitted as an electromagnetic set signal S41 through the transmission/reception coil 31 to the hand-driving coil 15*a*. When the transmission is finished, the transmission/reception control circuit 145 outputs the change-over signal S46 to change the transmission/reception change-over circuit 141 over to the receiving state and, at the same time, outputs the transmission end signal S47 to reset the start-of-measurement storage circuit 154.

On the other hand, the electromagnetic set signal S41 transmitted from the sound volume-adjusting device 2 is received by the hand-driving coil 15*a* of the electronic timepiece 1. The operation will now be described. In the electronic timepiece 1, the hand-driving circuit 14 is changed over to the receiving state in response to the reception possible signal S2 from the control signal-generating circuit 16, and the transmission signal from the sound volume-adjusting device 2 is received by the hand-driving coil 15*a* as the reception signal S12.

The reception signal S12 passes through the gate circuit 17 and is output as a sound volume set signal S4' after detected by a sound volume set signal-detecting circuit 18'. The detected sound volume set signals S4' are successively stored in the sound volume selection data-forming circuit 190 in response to the data shift signals S5 output from the control signal-generating circuit 16. After the sound volume set signals S4' are all stored, the data decoder 120 decodes the sound volume select data signal D1. When it is detected that the data have been transmitted from the sound volume-adjusting device 2, the data rewrite permit signal S7' is output to the control signal-generating circuit 116.

Upon receiving the data rewrite permit signal S7', the control signal-generating circuit 16 outputs the erase signal S8 which sets the acoustic signal-setting circuit 122*b* to the erase mode and, at the same time, operates the booster circuit S121, so that the data in the acoustic signal-setting circuit 122*b* is erased by the boosted signal S10. The control signal-generating circuit 16 then outputs the write signal S9 to set the acoustic signal-setting circuit 122*b* to the writing mode and, at the same time, to operate the booster circuit 21, so that the sound volume select data signal D1 is written into the acoustic signal-setting circuit 122*b* by the boosted signal S10 thereby to complete the sound volume adjustment.

In the present invention, the maximum sound volume is detected by measuring the sound volume maintaining an interval of one second. It is, however, possible to shorten the interval of measurement to shorten the time.

According to this embodiment as will be obvious from the foregoing description, it is possible to provide an electronic timepiece that makes it possible to easily select a sounding frequency for obtaining a maximum sound volume in any timepiece case structure and that is not adversely affected by any external factor such as shocks applied to the timepiece since the selected values of the frequency have been digitally stored, and thus it has an acoustic function having reliability for extended periods of time.

The electronic timepiece 1 which is the final product containing the acoustic device that generates the acoustic signal in response to the second data signal as mentioned in the above embodiment is completed by fabricating the module unit for mounting the counting circuit and acoustic signal-generating circuit and the case in separate steps, and then combining them together. In such an electronic timepiece, the acoustic signal is usually adjusted in the step of fabricating the module unit in such a manner that the acoustic signal obtained after the module unit is joined to the case becomes a maximum.

In many cases, however, a maximum acoustic signal is not obtained as designed after the case and the module unit are joined together due to changes in many factors.

In such a case, therefore, the case is removed from the once completed electronic timepiece, and adjustment is carried out again relying upon deviation data from the previous time in light of experience while expecting a predetermined range of adjustment.

At present, however, there is no guarantee that a proper acoustic signal will be obtained after the re-adjustment operation.

The above-mentioned embodiment of the present invention, therefore, is to provide a data transmission/reception system which, after the module unit and the case have been joined together, makes it possible to accomplish correct adjustment by using an external data transmission means, such that a maximum sound volume is obtained from the acoustic signal.

Concretely speaking, as described above, the acoustic signal generating means provided on the side of the module unit is equipped with a plurality of acoustic signal output circuits having different output levels, and predetermined acoustic signals are output from the individual acoustic signal output circuits at predetermined timings to the data transmission/reception device 2. That is, the acoustic signals are received by the microphone in the data transmission/reception device 2, their output levels are detected, and the results are stored in the predetermined storage means in the order received.

After the acoustic signals are all transmitted from the electronic timepiece 1 to the data transmission/reception device 2, the electronic timepiece 1 outputs a suitable inquiry data and requests the data transmission/reception device 2 to sends back a data signal related an acoustic signal that makes the output level maximum among the plurality of acoustic signals that were output. Then, the data transmission/reception device 2 sends an acoustic signal that makes the output level maximum out of the data stored in the storage means and further sends, depending upon the cases, the output level thereof back to the electronic timepiece 1. Based upon the data signal, the electronic timepiece selects only such an acoustic signal output circuit that makes the output level maximum out of the plurality of acoustic signal output circuits, and interrupts the functions of the other acoustic signal output circuits.

Example 5

The data transmission/reception system using the electronic timepiece equipped with sensor functions according to a second aspect of the present invention will now be described with reference to FIGS. 13 to 18.

As mentioned earlier, there have been proposed many multi-functional electronic timepieces. Among them, multi-functional electronic timepieces having such sensor functions as atmospheric pressure-measuring function, temperature-measuring function, altitude-measuring function and like functions, have been widely used.

In such multi-functional electronic timepieces, it is required that the sensor functions must be properly working at all times. In fact, however, the functions operate slightly differently depending upon the environmental conditions in which the electronic timepieces are placed, and it is difficult to correctly obtain the required data.

In an electronic timepiece having an atmospheric pressure-display function, for example, the atmospheric pressure data is usually adjusted in the module stage accompanied, however, by a problem in that the adjusted data deviates after the module is incorporated in the timepiece and the atmospheric pressure is not properly displayed.

As a method of solving the, above-mentioned problem inherent in the prior art, Japanese patent Application No. 62-266311 or U.S. Pat. No. 4,879,669 proposes an electronic timepiece having sensor functions, comprising an amplifier circuit for amplifying sensor output signals and an A/D converter circuit for subjecting the output of the amplifier circuit to the A/D conversion, wherein the two output data from the A/D converter circuit are stored in the two memories which are selected by manipulating the external control terminals, sensor characteristic equation is calculated from the two data stored in the two memories, and the output data of the A/D converter circuit is displayed on a display unit as sensor data which complies with the sensor characteristic equation (e.g., see Japanese Patent Application No. 62-266311, U.S. Pat No. 4,879,669).

The above-mentioned adjusting method can be digitally carried out making it possible to realize products that stably operate for extended periods of time compared with those obtained relying upon the mechanical adjustment using adjustment resistors and the like. In practice, however, though manipulation of the external control terminals makes it possible to accomplish the adjustment in the modular state of the timepiece, adjustment involves difficulty after the timepiece is completed.

Moreover, a complex step is required for adjusting again the multi-functional circuits by removing the case after the electronic timepiece is completed.

Therefore, it has been desired to provide a multi-functional electronic timepiece equipped with an case in a completed form which is capable of easily and correctly executing a predetermined adjusting operation by sending a second data signal to the electronic timepiece from an external unit without the need of disassembling the timepiece.

The object of this embodiment therefore is to provide a reference value writing system for an electronic timepiece with sensor functions, which enables the reference values for calculating the sensor characteristic equation to be automatically stored in the two memories in the state of the completed electronic timepiece without the need of manipulating the external operation member.

Namely, this embodiment deals with a data transmission/reception system for electronic timepieces comprising:

a data transmission/reception device which receives a second data signal from an external unit, generates a first data signal in response to said data signal that is received, and transmits said first data signal to the external unit;

an electronic timepiece equipped with a transmission/reception means which transmits the first data signal to said data transmission/reception device, and receives said second data signal from said data transmission/reception device; and a condition-varying means which provides changes in the external conditions of said electronic timepiece;

wherein said electronic timepiece is provided with a timing signal-generating means, said data transmission/reception device is provided with a timing signal-receiving means for receiving a timing signal output from the transmission/reception means of said electronic timepiece, and said data transmission/reception device transmits the data in synchronism with the timing signal that is received and controls the condition setting of said condition-varying means.

That is, using the data transmission/reception system according to this embodiment of the present invention, the multi-functional electronic timepiece having sensor functions can be adjusted for its sensor functions maintaining the electronic timepiece in its complete form without halting the operation of the electronic timepiece. In particular, the multi-functional electronic timepiece that needs to be adjusted is placed in an environmental condition-varying device such as an ambient atmospheric pressure-varying device or an ambient temperature-varying device that is capable of setting environment in which the electronic timepiece will be practically used, and the environmental conditions are intentionally varied by feeding data signals from an external unit to analyze the multi-functional characteristics of the electronic timepiece, the outputs of the sensors for the environmental conditions are stored and, then, the sensor functions are automatically adjusted inside the electronic timepiece.

More concretely speaking, the electronic timepiece has sensor functions, and the condition-varying means varies the conditions for the sensor functions.

When the sensor function is, for example, a pressure sensor function, then, the condition-varying means will be a pressure-varying device. Moreover, when the electronic timepiece has a temperature compensation function for the reference oscillator, the condition-varying means will be a temperature-varying device.

Concrete constitution of the data transmission/reception system using the electronic timepiece of this embodiment will now be described in detail with reference to FIGS. 13 to 16.

Figure 13:
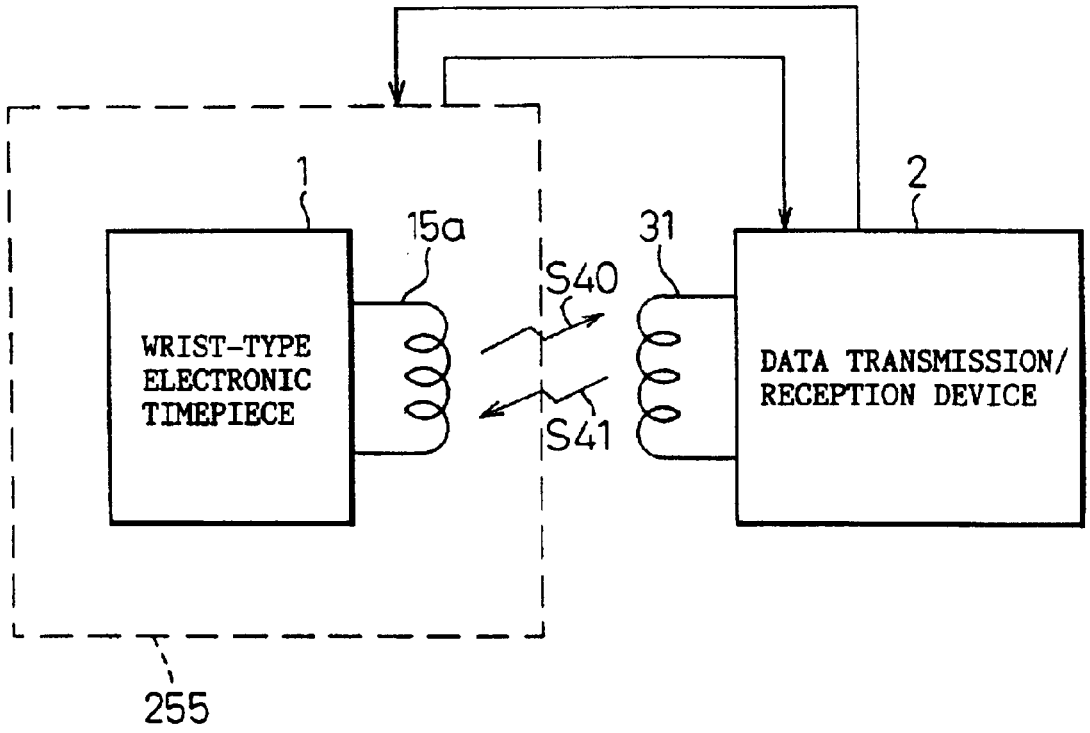
FIG. 13 is a block diagram of a data transmission/reception system comprising the wrist-type electronic timepiece having a sensor function and a write control device according to a fifth embodiment of the present invention.
Figure 14:
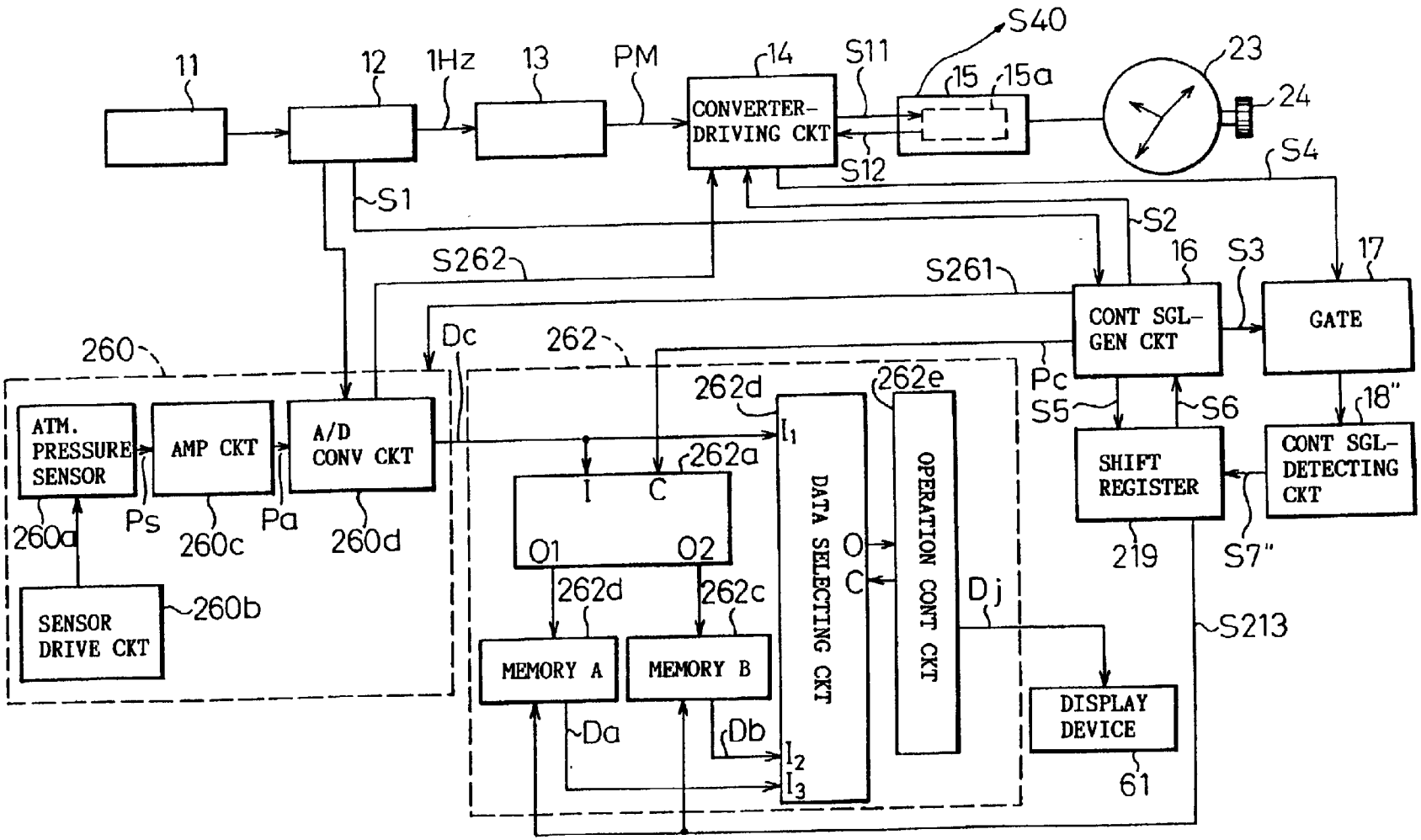
FIG. 14 is a block diagram illustrating major constituent portions in the wrist-type electronic timepiece of FIG. 13.
Figure 15:
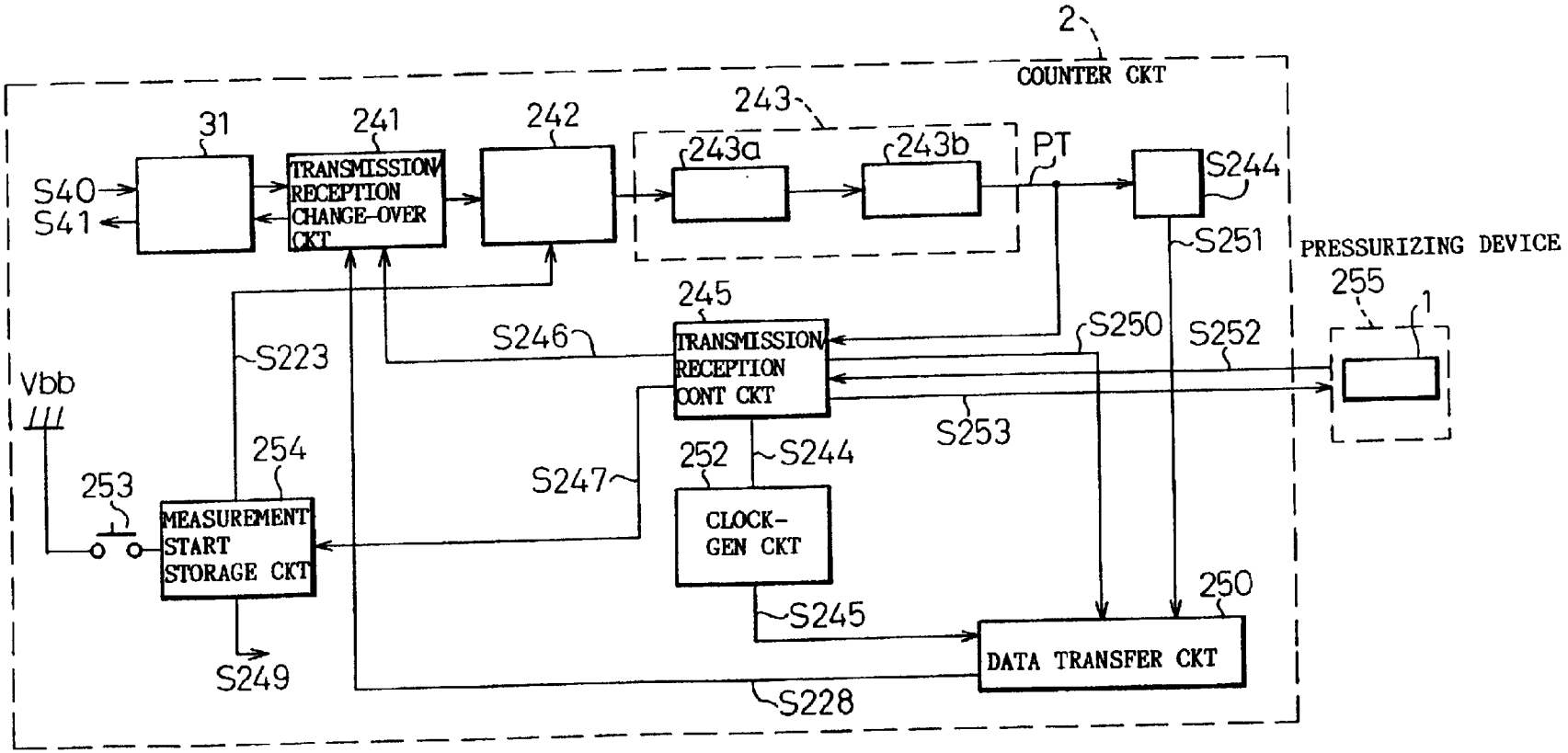
FIG. 15 is a block diagram illustrating major constituent portions in the write control device of FIG. 13.

FIGS. 13 to 15 are block diagrams illustrating concrete constitutions of the multi-functional electronic timepiece 1 and of the data transmission/reception device 2 for adjusting predetermined functions of the multi-functional electronic timepiece according to the embodiment.

That is, the fundamental constitution comprises:

an electronic timepiece with sensor functions comprising a sensor signal processing circuit 260 constituted by a linear sensor, an amplifier circuit for amplifying the output signal of the sensor, and an A/D converter circuit for subjecting the output of the amplifier circuit to the AID conversion;

a first memory and a second memory for storing two output data from the A/D converter circuit; and a sensor data processing circuit which receives the two data stored in said two memories, has a sensor characteristic equation calculation means 62*e* for calculating a sensor characteristic equation, and converts the output data from the A/D converter circuit into the sensor data in compliance with the sensor characteristic equation calculated by said sensor characteristic equation calculation means; and a data transmission/reception device that generates control signals to store the two output data from said A/D converter circuit in the first memory and in the second memory of said electronic timepiece; wherein said electronic timepiece has a control signal-generating circuit 16 that feeds control signals to said sensor signal-processing circuit and to said sensor data-processing circuit 261 and an input means that inputs the control signals from the control signal-generating circuit 16, and operates the A/D converter circuit in order to store the two output data from the A/D converter circuit in said first memory and in said second memory;

said data transmission/reception device has an output means 245 that controls the pressurizing device provided on the side of the electronic timepiece 1, detects an end signal from the A/D converter circuit in the electronic timepiece, and outputs storage control signals to store the two output data from the A/D converter circuit in the first memory and in the second memory; and said electronic timepiece stores the two output data from the A/D converter circuit in the first memory and in the second memory in response to said storage control signals.

The embodiment will now be described in conjunction with the drawings. FIG. 13 is a block diagram of a reference value writing system in a wrist-type electronic timepiece equipped with a sensor function according to the first embodiment of the present invention, and wherein reference numeral 1 denotes a wrist-type electronic timepiece equipped with a hand-driving coil 15*a* for driving the hands, and 2 denotes a data transmission/reception device equipped with a transmission/reception coil 31. The transmission/reception coil 31 transmits and receives data to, and from, the hand-driving coil 15*a*. The data transmission/reception device 2 receives through the transmission/reception coil 31 a timing signal generated from the hand-driving coil 15*a* of the wrist-type electronic timepiece 1, and transmits to the hand-driving coil 15*a* a transmission data in synchronism with a timing signal that is received. In this embodiment, on the electronic timepiece 1 is provided means for establishing a condition that is to be detected by the sensor function, i.e., is provided a pressurizing device 255 or the like device.

FIG. 14 is a block diagram of the circuit of the wrist-type electronic timepiece 1 according to the present invention, wherein reference numeral 11 denotes an oscillation circuit which employs a quartz oscillator to generate reference signals, 12 denotes a frequency-dividing circuit which outputs a 1-Hz signal and a frequency-divided signal S1 upon inputting an oscillation signal from the oscillation circuit 11, and reference numeral 13 denotes a drive signal-generating circuit which inputs the 1-Hz signal from the frequency-dividing circuit 12 and outputs to a hand-driving circuit 14 a motor drive pulse PM as a timing signal for driving the hands.

Reference numeral 15*a* denotes a hand-driving coil provided for a hand-driving device 15 to drive a hand 23, the hand-driving coil 15*a* working as a transmission/reception coil for transmitting and receiving the data to, and from, the data transmission/reception device 2. In this embodiment, a hand drive-driving signal S11 which is fed to the hand-driving coil 15*a* turns into a timing signal TM that is transmitted to the data transmission/reception device 2 and, hence, the drive signal-qenerating circuit 13 also works as a timing signal-generating circuit.

Reference numeral 16 denotes a control signal-generating circuit which inputs the frequency-divided signal S1, and outputs many control signals such as reception possible signal S2, and the like, to place the hand-driving circuit 14 in the receiving state. Reference numeral 17 denotes a gate circuit which inhibits or permits the passage of the signal S12 received from the hand-driving coil 15*a* in response to a detect permit signal 53 output from the control signal-generating circuit 16.

Reference numeral 18" denotes a control signal-detecting circuit which converts the reception signal S12 that has passed through the gate circuit 17 into a control data S7". Reference numeral 219 denotes a shift register which stores the control data S7" from the control signal-detecting circuit 18" in response to a data shift signal S5 output from the control signal-generating circuit 16, and outputs a control signal S6 and a write signal S213.

Reference numeral 260 denotes the sensor signal-processing circuit constituted by an atmospheric pressure sensor 260*a*, a sensor-driving circuit 260*b*, an amplifier circuit 260*c* and an A/D converter circuit 260*d*, and is operated by an A/D start signal S261 output from the control signal-generating circuit 16. Reference numeral 260*a* denotes the atmospheric pressure sensor which outputs a sensor signal Ps proportional to the atmospheric pressure, 260*b* is the sensor-driving circuit which feeds a constant current to the atmospheric pressure sensor 260*a* to drive it, and 260*c* is the amplifier circuit which has a predetermined'amplification factor without its sensitivity and offset being adjusted. Therefore, the sensor signal Ps is amplified by a predetermined amplification factor and is output as an amplified signal Pa which is then converted into a data Dc through the A/D converter circuit 260*d*.

Reference numeral 262 denotes the sensor data processing circuit which is constituted by a memory setting circuit 262*a*, a memory A 262*b* which is a first memory, a memory B 262*c* which is a second memory, a data selection circuit 262*d*, and a calculation control circuit 262*e* which is a sensor characteristic equation calculation means. The memory setting circuit 262*a* outputs through a terminal 01 or 02 the converted data Dc input to a terminal I from the A/D converter circuit 260*d* in response to a select signal Pc that is input to a terminal C from the control signal-generating circuit 16; i.e., the converted data Dc is stored in the memory A 262*b* or in the memory B 262*c*.

The converted data Dc output from the terminal 01 of the memory setting circuit 262*a* is stored in the memory A 262*b* as memory data Da in response to a write signal S213 from the shift register 219.

The converted data Dc output from the terminal 02, on the other hand, is stored in the memory B 262*c* as memory data Db in response to the write signal S213 from the shift register 219. The memory A 262*b* and the memory B 262*c* are nonvolatile memories which, after having stored the data in response to the write signals S213 from the shift register 219, maintain the contents even after the power source is interrupted. In response to a control signal fed from the operation control circuit 262*e* to a terminal C, the data selecting circuit 262*d* selectively outputs through a terminal 0 the converted data Dc that is input to a terminal I1, the memory data stored in the memory A 262*b* input to a terminal I3 or the memory data Db stored in the memory B 262*c* input to a terminal I2, and feeds it to the operation control circuit 262*e*.

FIG. 15 is a block diagram of the circuit of the data transmission/reception device 2 according to the present invention. The data transmission/reception device 2 according to this embodiment is a write control device which receives the hand-moving pulse from the wrist-type electronic timepiece 1 as a timing signal, outputs a control signal based thereupon, transmits and receives data to, and from, the wrist-type electronic timepiece 1, and stores the converted data Dc input to the terminal I thereof from the A/D converter circuit 260*d* in the memory A 262*b* and in the memory B 262*c* as reference values. Reference numeral 31 denotes the coil for transmission and reception, 241 denotes a transmission/reception change-over circuit which controls the change-over operation to receive a timing signal from the hand-driving coil 15*a* and to transmit the data to the hand-driving coil 15*a* depending upon a change-over signal S246 from a transmission/reception control circuit 245 that will be described later, 242 denotes a gate circuit which inhibits or permits the passage of the timing signal, 243 denotes a signal-detecting circuit which is constituted by a filter circuit 243*a* and an amplifier circuit 243*b*, inputs the timing signal from the gate circuit 242 and outputs it as a reception signal PT, reference numeral 244 denotes a counting circuit that inputs the reception signals PT, counts them, and outputs a count signal S251.

Reference numeral 254 denotes a start-of-measurement storage circuit which, upon the manipulation of a switch 253, outputs a system clear signal S249 for initializing the write control device 2 and the pressure of the pressurizing device 255 and, at the same time, outputs a reception permit signal S223, so that the gate circuit 242 permits the passage of the timing signal from the hand-driving coil 15*a*, reference numeral 245 denotes a transmission/reception control circuit which inputs the reception signal PT and outputs many control signals such as a change-over signal S246, and the like, to place the transmission/reception change-over circuit 241 in the transmitting state, and reference numeral 255 denotes a pressurizing device in which the wrist-type electronic timepiece 1 will be placed so as to be adjusted. The pressurizing device 255 begins the pressurizing operation in response to a pressurization instruction signal S253 from the transmission/reception control circuit 245, and outputs a pressurization end signal S252 when a predetermined pressurized state is reached.

Reference numeral 250 denotes a data transfer circuit which inputs the count signal S251, and is latched by a latch signal S250 which is output from the transmission/reception control circuit 245, and outputs a transmission signal S228 in which the count signals S251 are transformed into serial data in response to clock signals S245 from a clock-generating circuit 252 that will be described below. Reference numeral 252 denotes the clock generating circuit which outputs the clock signal S245 for driving the data transfer circuit 250 in response to a start signal S244 output from the transmission/reception control circuit 245. Further, a transmission end signal S247 output from the transmission/reception control circuit 245 resets the start-of-measurement storage circuit 254 to initialize the data transmission/reception device 2 which is the write control device and, at the same time, the gate circuit 242 inhibits the passage of the timing signal from the hand-driving coil 15*a*.

Next, operation of the reference value writing system of the wrist-type electronic timepiece 1 equipped with the sensor functions constituted as described above, will now be explained with reference to a time chart shown in FIG. 16. In an ordinary operation of the wrist-type electronic timepiece 1, the drive signal-generating circuit 13 receives a 1-Hz signal from the frequency-dividing circuit 12 and outputs a motor drive pulse PM which is a timing signal. The hand-driving circuit 14 receives the motor drive pulse PM and feeds the hand drive-driving signal S11 to the hand-driving coil 15*a* which then drives the hand-driving device 23 to display the time while effecting the one-second hand movement. After the one-second hand movement is finished, the control signal-generating circuit 16 receives the frequency-divided signal S1 from the frequency-dividing circuit 12 and outputs a reception possible signal S2 to change the hand-driving circuit 14 over to the receiving state, such that a transmission signal S228 from the write control device 2 is received by the hand-driving coil 15*a*. At the same time, the control signal-generating circuit 16 outputs a detection permit signal S3 so that the gate circuit 17 permits the passage of the reception signal S12. Thus, the wrist-type electronic timepiece 1 finishes its hand-moving operation and is held in a reception possible state for a period of the reception possible signal S2 until the next hand-moving operation.

In order to receive the timing signal from the wrist-type electronic timepiece 1, on the other hand, the write control device 2 is, first, initialized by manipulating the switch 253. Upon manipulating the switch 253, the start-of-measurement storage circuit 254 outputs a system clear signal S249 and a reception permit signal S223. In response to the system clear signal S249, the transmission/reception change-over circuit 241 is changed over to the reception mode so as to receive the timing signal S40 from the wrist-type electronic timepiece 1. At the same time, the reception permit signal S223 controls the gate circuit 242 to permit the passage of the timing signal from the transmission/reception coil 31. The timing signal S40 received from the wrist-type electronic timepiece 1 in this state passes through the gate circuit 242 and is input to the signal-detecting circuit 242; i.e., the signal-detecting circuit 243 detects the reception signal PT which is the first timing signal (timing t1 in the time chart of FIG. 16). The counter circuit 244 counts the first reception signal PT1 and outputs a count signal S251.

Upon receiving the signal PT, the transmission/reception control circuit 245 outputs a latch signal S250 in response to which the data transfer circuit 250 stores the count signal S251. At the same time, the transmission/reception control circuit 245 outputs a start signal S244 in response to which the clock-generating circuit 252 operates to output a clock signal 5245. In response to the clock signal S245, the data transfer circuit 250 outputs the count signal S251 stored therein as a transmission signal S228 (timing t2 of the time chart of FIG. 16). The transmission signal S228 is transmitted to the wrist-type electronic timepiece 1 via the transmission/reception change-over circuit 241 and the transmission/reception coil 31.

In the wrist-type electronic timepiece 1, the hand-driving circuit 14 is changed by the reception possible signal S2 of the control signal-generating circuit 16 over to the receiving state, and the signal S228 transmitted from the write control device 2 is received as the reception signal S12 by the hand-driving coil 15*a*. The reception signal S12 passes through the gate circuit 17, detected by the control signal-detecting circuit 18" and is output as a control data S7". The detected control data S7" are successively stored in the shift register 219 in response to data shift signals S5 output from the control signal-generating circuit 16. When the control data S7" are all stored, a control signal S6 is output. In response to the control signal S6, the control signal-generating circuit 16 outputs an A/D start signal S261 to actuate the sensor signal-processing circuit 260 (timing t2 in the time chart of FIG. 16).

Figure 16:
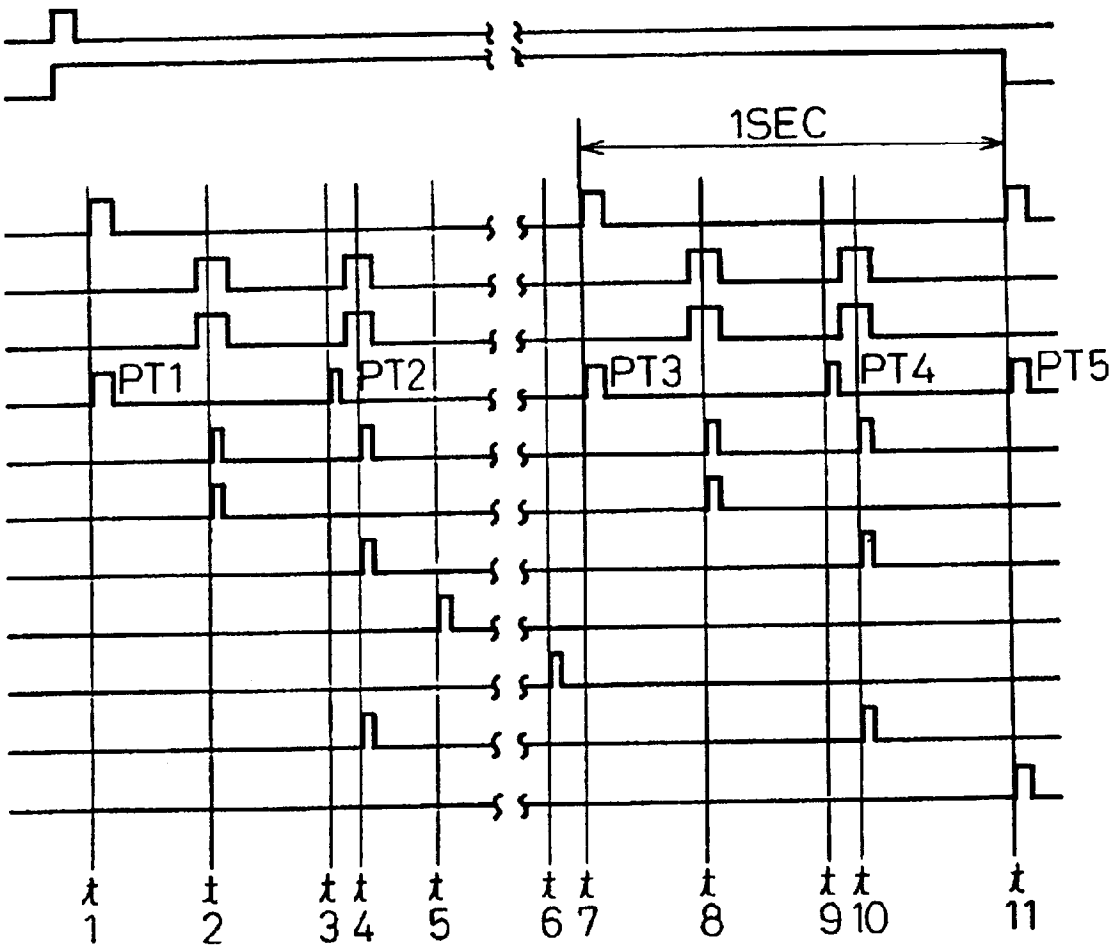
FIG. 16 is a time chart for explaining the operation of the fifth embodiment.

After the A/D conversion is finished, the sensor signal-processing circuit 260 outputs an A/D end signal S262 (timing t3 in the time chart of FIG. 16).

The A/D end signal S262 is transmitted as an electromagnetic signal to the write control device via the hand-driving circuit 14 and the hand-driving coil 15*a*.

The A/D end signal S262 received by the write control device 2 passes through the gate circuit 242, and is input to the signal-detecting circuit 243; i.e., the signal-detecting circuit 243 detects the received signal PT (timing t3 in the time chart of FIG. 16). The counter circuit 244 counts the received signals PT2 and outputs a count signal S251. Upon receiving the signal PT, the transmission/reception control circuit 245 outputs a latch signal S250 in response to which the data transfer circuit 250 stores the count signal S251 and, at the same time, outputs a start signal S244 in response to which the clock-generating circuit 252 operates to output a clock signal S245. In response to the clock signal S245, the data transfer circuit 250 outputs the count signal S251 stored therein as a transmission signal S228 (timing t4 in the time chart of FIG. 16). The transmission signal S228 is transmitted to the wrist-type electronic timepiece 1 via the transmission/reception change-over circuit 241 and the transmission/reception coil 31.

In response to the reception possible signal S2 output from the control signal-generating circuit 16, the wrist-type electronic timepiece 1 changes the hand-driving circuit 14 over to the receiving state, so that the signal S228 transmitted from the write control device 2 is received as a reception signal S12 by the hand-driving coil 15*a*. The signal S12 that is received passes through the gate circuit 17 and is detected by the control signal-detecting circuit 18" and is output as a control data S7". The detected control data S7" are successively stored in the shift register 219 in response to data shift signals S5 output from the control signal-generating circuit 16. After the control data S7" are all stored, a control signal S6 and a write signal S213 are output. The control signal-generating circuit 16 outputs a select signal Pc in response to the control signal S6. In response to a select signal Pc input to the terminal C from the control signal-generating circuit 16, the memory setting circuit 262*a* outputs from the terminal 01 thereof the converted data Dc that is input to the terminal I from the A/D converter circuit 260*d*, and stores it in the memory A 262*b* in response to a write signal S213 (timing t4 in the time chart of FIG. 16).

After having transmitted the write signal S213, the write control device 2 outputs a pressurization instruction signal S253 to operate the pressurizing device 255 to be ready for measuring a second reference pressure value (timing t5 in the time chart of FIG. 16). After the passage of the pressure stabilizing time (timing between timings t5 and t6 in the time chart of FIG. 16), the pressurizing device 255 outputs a pressurization end signal S252 to the transmission/reception control circuit 245. Then, as the next timing signal output from the wrist-type electronic timepiece 1 is received by the transmission/reception coil 31 causing the signal-detecting circuit 243 to output a third reception signal PT3 (timing t7 in the time chart of FIG. 6), the transmission/reception control circuit 245, upon receipt of the signal PT, outputs a latch signal S250 in response to which the data transfer circuit 250 stores the count signal S251. At the same time, the transmission/reception control circuit 245 outputs the start signal S244 which causes the clock-generating circuit 252 to output a clock signal S245. In response to the clock signal S245, the data transfer circuit 250 outputs the count signal S251 stored therein as a transmission signal S228 (timing t8 in the time chart of FIG. 16). The transmission signal S228 is transmitted to the wrist-type electronic timepiece 1 via the transmission/reception change-over circuit 241 and the transmission/reception coil 31.

In the time chart of FIG. 16, operations at timings t7, t8 and t9 are the same as the operations at the preceding timings t1, t2 and t3, and are not described here. Therefore, the following description starts with a timing t10 in the time chart of FIG. 16. In response to the reception possible signal S2 output from the control signal-generating circuit 16, the wrist-type electronic timepiece 1 changes the hand-driving circuit 14 over to the receiving state, so that the signal S228 transmitted from the write control device 2 is received as a received signal S12 by the hand-driving coil 15*a*. The signal S12 that is received passes through the gate circuit 17 and is detected by the control signal-detecting circuit 18" and is output as a control data S7". The detected control data S7" are successively stored in the shift register 219 in response to data shift signals S5 output from the control signal-generating circuit 16. After the control data S7" are all stored, a control signal S6 and a write signal S213 are output. The control signal-generating circuit 16 outputs a select signal Pc in response to the control signal S6. In response to a select signal Pc input to the terminal C from the control signal-generating circuit 16, the memory setting circuit 262*a* outputs from the terminal 02 thereof the converted data DC that is input to the terminal I from the A/D converter circuit 260*d*, and stores it in the memory B 262*c* in response to a write signal S213 (timing t10 in the time chart of FIG. 16).

Then, as a timing signal output from the wrist-type electronic timepiece 1 is received by the transmission/reception coil 31 causing the signal-detecting circuit 243 to output a fifth reception signal PT5 (timing t11 in the time chart of FIG. 16), the transmission/reception control circuit 245 receiving the reception signal PT5 outputs a transmission end signal S247. The transmission end signal S247 from the transmission/reception control circuit 245 is input to the start-of-measurement storage circuit 254 to reset it; i.e., the reception permit signal S223 is no longer output and the gate circuit 242 is closed. Thus, one time of reference value writing operation is finished. When it is desired to effect the reference value writing operation again, the switch 253 should be depressed.

According to the present invention as will be obvious from the above description, the hand-driving coil in the wrist-type electronic timepiece is also utilized as a coil for receiving signals transmitted from an external unit, enabling reference values for calculating a sensor characteristic equation to be automatically stored in the two memories in a state in which the electronic timepiece is finished, presenting great advantage from the standpoint of production.

Embodiment 6

Another application of the data transmission/reception system according to the present invention will be described next as embodiment 6 with reference to FIGS. 17 and 18.

This embodiment deals particularly with an electronic timepiece of high precision among many multi-functional electronic timepieces, i.e., deals with an electronic timepiece having such a very high precision as a yearly variation in pace of several seconds. In an electronic timepiece, in general, the driving circuit and, particularly, the oscillation circuit undergoes a change depending upon the temperature, and deviation from the standard time undergoes a change, too, depending upon a change in temperature and a change in environment.

In order to adjust for variation in the pace caused by a change in temperature, therefore, there has been proposed an adjustment method which adds a temperature compensation function circuit. According to the conventional method, however, adjustment is accomplished in a modular state which, however, undergoes a variation when the module is fitted into the case, making it difficult to obtain high precision despite the fact that the adjustment is accomplished.

This embodiment, therefore, provides a data transmission/reception system for realizing a high-precision electronic timepiece which enables the pace to be easily and correctly adjusted by actuating the temperature compensation function by simply sending a first data signal from an external unit without halting the operation of the electronic timepiece and without the need of disassembling the electronic timepiece, either, by solving the problems inherent in the prior art.

Figure 17:
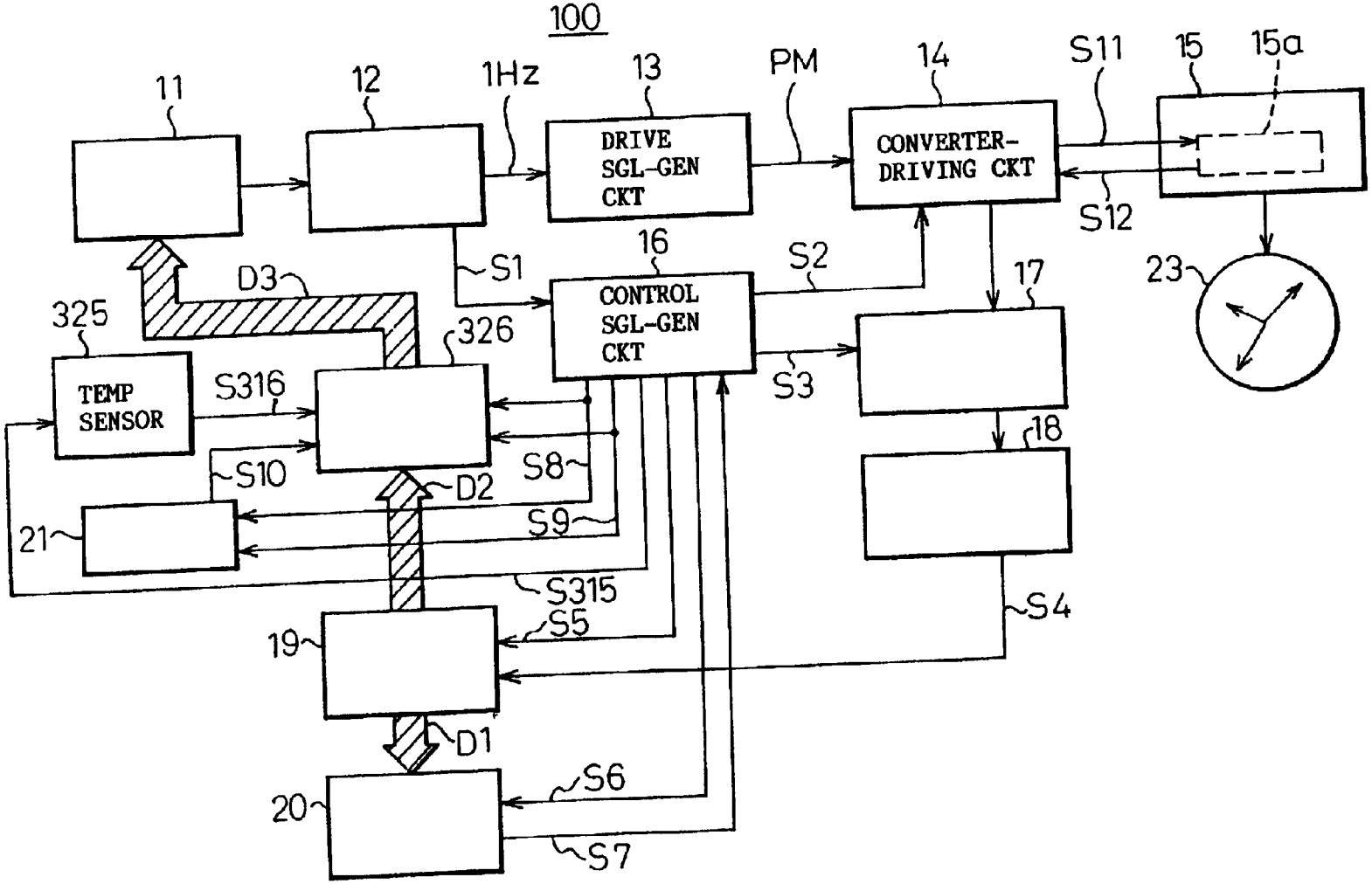
FIG. 17 is a block diagram illustrating the circuit constitution, of the electronic timepiece, used for a sixth embodiment of the present invention.

FIG. 17 is a block diagram illustrating the constitution of the electronic timepiece according to this embodiment.

The fundamental constitution is nearly the same as the constitution of the electronic timepiece shown in FIG. 2, and in which the same constituent portions are denoted by the same reference numerals as those of FIG. 2.

Reference numeral 11 denotes an oscillation circuit using a quartz oscillator to generate reference signals, which works to adjust the pace and to compensate the temperature by time-divisionally controlling the oscillation capacitor in response to a temperature compensation signal D3 from a temperature compensation data storage circuit 326.

The temperature correction data storage circuit 326 is equipped with a data memory constituted by a nonvolatile memory or the like memory, and an operation means for calculating a temperature correction signal D3 from the data thereof, and receives from the shift register 19 a data signal D2 made up of three pace data for different temperatures, calculates a temperature calculation formula from the three pace data and stores it, and calculates a correction amount in line with the temperature calculation formula, and feeds it as a temperature correction signal D3 to the oscillation circuit 11.

Reference numeral 325 denotes a temperature sensor which is operated by a sensor drive signal S315 output from the control signal-generating circuit 16, and feeds a temperature data signal S316 with which the temperature correction data storage circuit 326 calculates the temperature correction signal D3.

Figure 18:
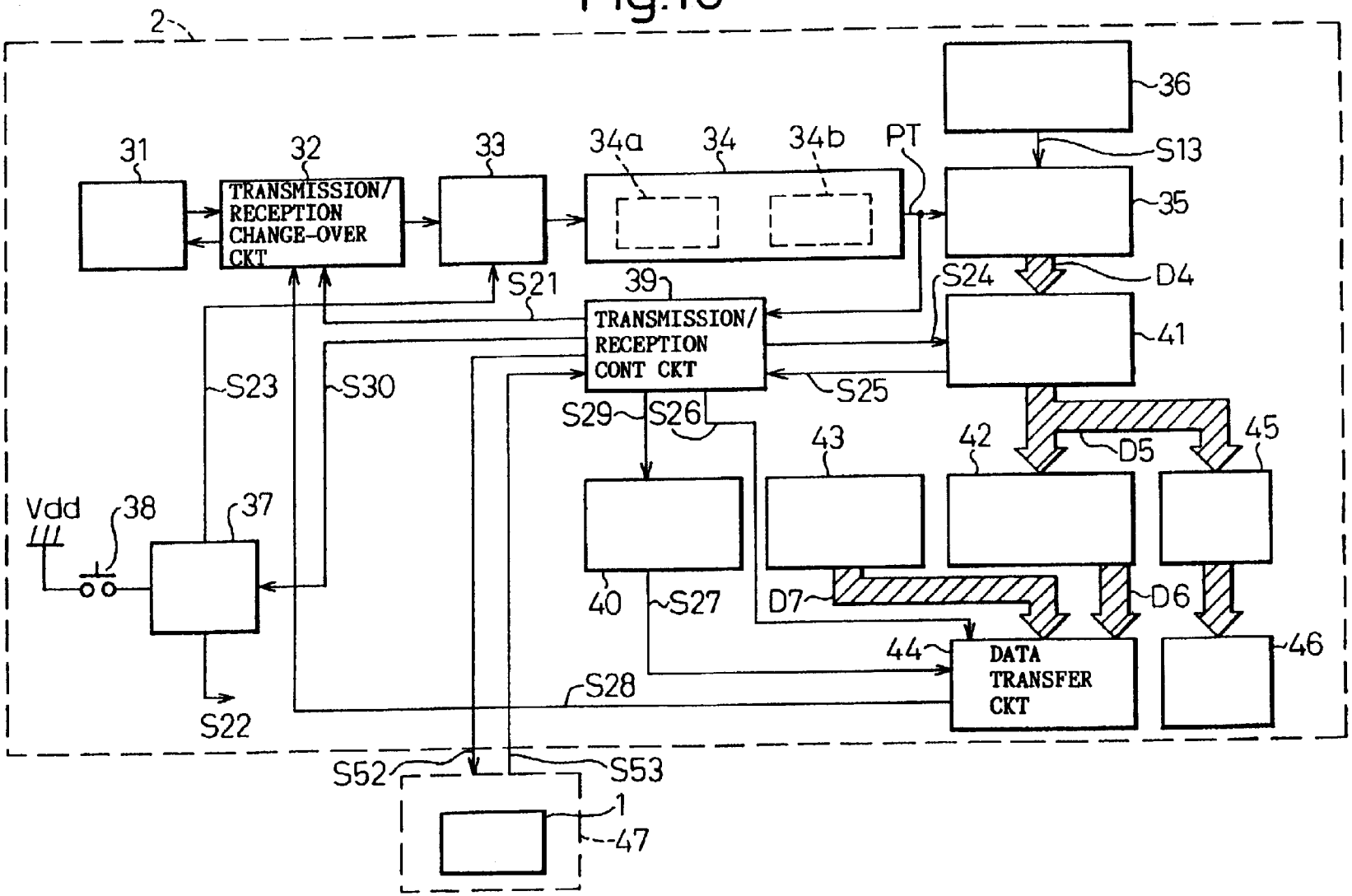
FIG. 18 is a block diagram illustrating the circuit constitution on the side of the data transmission/reception device according to the sixth embodiment of the present invention.

FIG. 18 is a block diagram illustrating a temperature correction data transmission device 2 that works as a data transmission/reception device 2 for the electronic timepiece 1 having a temperature compensation function, and a temperature vessel 47 which is a condition-varying device that provides a change in external conditions for the electronic timepiece 1.

The fundamental constitution of the circuit is nearly the same as that of FIG. 3, and the same constituent portions as those of FIG. 3 are denoted by the same reference numerals.

In the temperature vessel 47 is contained the electronic timepiece 1.

The temperature compensation operation of the embodiment will now be described with reference to FIGS. 17 and 18.

First, the operation for setting the temperature correction function consists of placing the electronic timepiece 1 in the temperature vessel 47, and operating the switch 38 of the temperature correction data transmission device 2 which is the data transmission/reception device 2, thereby to initialize the temperature correction data transmission device 2.

Then, the transmission/reception control circuit 39 outputs a temperature specifying signal S52 for setting the temperature vessel 47 at a temperature T1.

When a predetermined temperature T1 is reached, the temperature vessel 47 outputs a temperature setting end signal S53.

In this state as explained with reference to FIGS. 2 and 3, a pace detect pulse PT from the electronic timepiece 1 is received to measure a pace data H1 at the temperature T1. The pace data H1 is set as a second data signal D6 to the data transfer circuit 44.

At the same time, the temperature specifying signal S52 for setting the temperature T2 is fed to the temperature vessel 47. Upon receiving the temperature setting end signal S53 of the temperature T2 from the temperature vessel 47, a pace data H1 at the temperature T2 is measured and is set as a second data signal D6 to the data transfer circuit 44.

Next, to measure a pace data H3 of the third time, the temperature vessel 47 is set at a temperature T3; i.e., the pace data H3 is measured and is set as a second data signal D6 to the data transfer circuit 44.

After the measurement of the pace data of the third time is finished, the data transfer circuit 44 outputs pace data H1, H2 and H3 as transmission signals S28 that correspond to the second data signals D6 in synchronism with the timing signals from the electronic timepiece 1.

In the electronic timepiece 1, the transmission signals S28 from the temperature correction data transmission device 2 are received and are input as pace signals S4 to the shift register 19 which outputs the thus input pace signals S4 as data signals D2.

The temperature correction data storage circuit 326 calculates and stores the temperature calculation equation for obtaining the temperature correction signal D3 from the data signal D2 made up of three pace signals and, thus, exhibits a temperature correction function.

In the usual electronic timepiece 1, the temperature sensor 325 is operated by the sensor drive signals S15 periodically generated from the control signal-generating circuit 16, and outputs a temperature data signal S316 that corresponds to the temperature.

The temperature correction data storage circuit 326 calculates the temperature correction signal D3 relying upon the temperature data signal S316 and the temperature calculation formula, and feeds it to the oscillation circuit 11.

Based on the temperature correction signal D3, the oscillation circuit 11 adjusts the pace with respect to the temperature by controlling the time-dividing ratio of the oscillation capacitor, making it possible to realize a highly precise electronic timepiece.

Though the above embodiments have dealt with the systems that effect the mutual communication at all times, the invention is in no way limited to such embodiments only. For instance, the mutual communication mode may be established by pulling the crown of the electronic timepiece and the mutual communication may be carried out only within this period, making it possible to decrease wasteful consumption of current and to decrease the likelihood of infiltration of noise.

In the data transmission/reception system using the electronic timepiece according to the present invention as described above, there is constituted a synchronous communication system which carries out two-way communication by sending a synchronizing signal (timing signal) necessary for the adjusting operation from the side of the electronic timepiece 1, and sending a second data signal adapted to adjusting the electronic timepiece from the data transmission/reception device 2 which is an external device to the electronic timepiece 1 in synchronism with the timing signal.

According to the above-mentioned system of the present invention, mutual communication is reliably carried out by the synchronous operation using timing signals. Furthermore, the electronic timepiece which employs a small cell as a power source and has little margin in energy generates a timing signal to control the timing in the operation of the mutual communication, and the external transmission/reception device that has a margin in energy works responding thereto. Therefore, the electronic timepiece is allowed to save the consumption of energy contributing to lengthening the life of the cell.

Moreover, employment of the synchronous operation makes it possible to carry out the mutual communication without halting the fundamental operation of the electronic timepiece. Unlike the conventional open system, therefore, no operation is required for correcting the time after the communication has been finished. By continuously controlling the external transmission/reception device and the environment-varying device in synchronism with the timing signal from the electronic timepiece, furthermore, a variety kinds of characteristics can be adjusted when the electronic timepiece is in a finished state.

According to the present invention, furthermore, the synchronizing signal, i.e., the timing signal is obtained by utilizing a pulse motor drive signal for driving the hands.

Moreover, according to the present invention, the second data signal which is an adjustment data sent from the data transmission/reception device 2 in synchronism with the synchronizing signal, is a reception permit signal that can be received by the electronic timepiece only for a predetermined period of time, and there is output, in synchronism with the synchronizing signal, a reception permit period varying signal that varies the reception permit period.

The reception permit period varying signal works to broaden the width of the reception permit signal when it is being received from the external unit during the reception permit period.

The present invention is so constituted as to carry out the two-way communication during the non-driving period of the pulse signals without interrupting the pulse motor driving signals that are used as timing signals.

Moreover, the data transmission/reception system of the invention includes a method in which after the reception of the second data signals from the external unit is started, the pulse motor is temporarily halted, and this delay of time is brought back to the normal time by the time restoring operation after the transmission of the data signals has been finished.

The present invention is further capable of automatically executing the operation for quickening or slowing the pace.

The operations for adjusting various functions of the multi-functional electronic timepiece aided by the data transmission/reception system of the present invention will include operation for adjusting the sound volume, operation for adjusting the sensors relying upon characteristic curves, and operation for calling preset values of the timepiece such as storing predetermined data (Id, initials, phone numbers, personal identification numbers, etc.) in the electronic timepiece, and reading or calling the data by using external data signals.

What is claimed is:

1. A data transmission/reception system for an electronic timepiece comprising:

a data transmission/reception device which receives a timing signal from an electronic timepiece, generates a data signal in response to said timing signal that is received, and transmits said data signal to the electronic timepiece;

said electronic timepiece equipped with a transmission/reception means for transmitting the timing signal to said data transmission/reception device, and for receiving said data signal from said data transmission/reception device;

timing signal-generating means in said electronic timepiece for outputting said timing signal;

timing signal-receiving means in said data transmission/reception device for receiving the timing signal from the transmission/reception means of said electronic timepiece;

means in said data transmission/reception device for transmitting said data signal to said electronic timepiece on the basis of the timing signal received from the electronic timepiece; and wherein said electronic timepiece is so constituted as to rewrite the data in said electronic timepiece in response to the data signal transmitted from said data transmission/reception device.

2. A data transmission/reception system according to claim 1, wherein said electronic timepiece has a data signal detection permitting means which, after said timing signal is generated, enables the data signal transmitted from said data transmission/reception device to be received for only a predetermined period of reception possible time.

3. A data transmission/reception system according to claim 2, wherein said data signal detection permitting means has a permit time varying means for varying the time period of said reception possible time.

4. A data transmission/reception system according to claim 3, wherein the length of said reception possible time is set to be short when the electronic timepiece is in a state of waiting for the reception and is set to be long when the electronic timepiece is in a receiving state.

5. A data transmission/reception system according to claim 1 or 2, wherein said electronic timepiece is provided with a hand drive means for driving the hands, and the coil for driving the hands also works as said transmission/reception means.

6. A data transmission/reception system according claim 5, wherein said timing signal-generating means is a drive signal-generating circuit of said hand drive means, and said timing signal is a drive signal for driving said hands.

7. A data transmission/reception system according to claim 6, wherein said data signal detection permitting means sets a reception possible period in the hand non-driving period between said drive signals.

8. A data transmission/reception system according to claim 6, wherein a timing signal generated by said timing signal-generating means has a pulse width which is smaller than that of said hand drive signal, and does not drive said hand drive means even when it is applied to the coil for driving said hands.

9. A data transmission/reception system according to claim 8, wherein said timing signal-generating means is a pace detect pulse-generating circuit, and said timing signal is a pace detect pulse applied to the coil for driving said hands.

10. A data transmission/reception system according to claim 1, wherein said data transmission/reception device generates said data signal that is obtained through a predetermined operational processing in response to said timing signal transmitted from said electronic timepiece and in synchronism with said timing signal.

11. A data transmission/reception system according to claim 1, wherein the timing signal from said electronic timepiece is a characteristic data signal related to said electronic timepiece.

12. A data transmission/reception system according to claim 11, wherein said electronic timepiece is provided with a circuit for generating said characteristic data signal and a storage means for storing said characteristic data signal.

13. A data transmission/reception system according to claim 11 or 12, wherein said data transmission/reception device has a characteristic data signal-detecting means for detecting said characteristic data signal output from said electronic timepiece, and a data signal-forming means for forming the data signal that will be transmitted to said electronic timepiece based upon said characteristic data signal.

14. A data transmission/reception system according to claim 13, wherein said characteristic data signal-detecting means is a pace signal-detecting means for said electronic timepiece, and said data signal-forming means is a pace adjusting amount data signal-forming means.

15. A data transmission/reception system according to claim 13, wherein said characteristic data signal-detecting means is an acoustic signal-detecting means for detecting the acoustic signal output from the acoustic device of said electronic timepiece, and said data signal-forming means is an acoustic setting data-forming means.

16. A data transmission/reception system according to claim 11, wherein said characteristic data signal is the one selected from a pace signal, an acoustic signal, a pressure characteristic signal or any similar like signal.

17. A data transmission/reception system for an electronic timepiece comprising:

a data transmission/reception device which receives a timing signal from an electronic timepiece, generates a data signal in response to said timing signal that is received, and transmits said data signal to the electronic timepiece;

said electronic timepiece equipped with a transmission/reception means for transmitting the timing signal to said data transmission/reception device, and for receiving said data signal from said data transmission/reception device;

timing signal-generating means in said electronic timepiece for outputting said timing signal;

timing signal-receiving means in said data transmission/reception device for receiving the timing signal from the transmission/reception means of said electronic timepiece;

means in said data transmission/reception device for transmitting said data signal to said electronic timepiece after detecting the timing signal received from the electronic timepiece; and wherein said electronic timepiece is so constituted as to rewrite the data in said electronic timepiece in response to the data signal transmitted from said data transmission/reception device.

18. A data transmission/reception system according to claim 17, wherein said data transmission/reception device generates said data signal that is obtained through a predetermined operational processing in response to said timing signal transmitted from said electronic timepiece and after detecting the said timing signal.

19. A data transmission/reception system for an electronic timepiece comprising:

a data transmission/reception device which receives a timing signal from an electronic timepiece, generates a data signal in response to said timing signal that is received, and transmits said data signal to the electronic timepiece;

said electronic timepiece equipped with a transmission/reception means for transmitting the timing signal to said data transmission/reception device, and for receiving said data signal from said data transmission/reception device;

timing signal-generating means in said electronic timepiece for outputting said timing signal;

timing signal-receiving means in said data transmission/reception device for receiving the timing signal from the transmission/reception means of said electronic timepiece; and means in said data transmission/reception device for transmitting said data signal to said electronic timepiece on the basis of the timing signal received from the electronic timepiece, such that said electronic timepiece is adjustable in response to receipt of said data signal without halting the operation of said electronic timepiece.

20. A data transmission/reception system for an electronic timepiece comprising:

a data transmission/reception device which receives a timing signal from an electronic timepiece, generates a data signal in response to said timing signal that is received, and transmits said data signal to the electronic timepiece;

said electronic timepiece equipped with a transmission/reception means for transmitting the timing signal to said data transmission/reception device, and for receiving said data signal from said data transmission/reception device;

timing signal-generating means in said electronic timepiece for outputting said timing signal;

timing signal-receiving means in said data transmission/reception device for receiving the timing signal from the transmission/reception means of said electronic timepiece; and means in said data transmission/reception device for transmitting said data signal to said electronic timepiece after detecting the timing signal received from the electronic timepiece, such that said electronic timepiece is adjustable in response to receipt of said data signal without halting the operation of said electronic timepiece.

21. A data transmission/reception system for an electronic timepiece comprising:

a data transmission/reception device for transmitting a data signal;

an electronic timepiece including a transmission/reception means for receiving said data signal from said data transmission/reception device, and a timing signal-generating means, and wherein the transmission/reception means includes a timing signal-transmitting means responsive to the timing signal-generating means for outputting a timing signal;

said data transmission/reception device including a timing signal-receiving means for receiving the timing signal from said timing signal-transmitting means;

wherein said data transmission/reception device determines a data transmission timing in response to the received timing signal, and then transmits said data signal to said electronic timepiece in accordance with the timing of said timing signal; and wherein the electronic timepiece includes a multi-functional, wrist-type, electronic timepiece having driven hands, and further includes means for adjusting a function of the wrist-type electronic timepiece in response to receipt of said data signal from the data transmission/reception device while the wrist-type electronic timepiece maintains a hand-driving state.

* * * * *